US009685724B2

(12) United States Patent
Tojo

(10) Patent No.: US 9,685,724 B2
(45) Date of Patent: Jun. 20, 2017

(54) CONNECTOR AND CONNECTOR ASSEMBLY INCLUDING THE SAME

(71) Applicant: PANASONIC INTELLECTUAL PROPERTY MANAGEMENT CO., LTD., Osaka (JP)

(72) Inventor: Katsutoshi Tojo, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/191,611

(22) Filed: Jun. 24, 2016

(65) Prior Publication Data

US 2016/0380373 A1 Dec. 29, 2016

(30) Foreign Application Priority Data

Jun. 26, 2015 (JP) ..... 2015-128313

(51) Int. Cl.
*H01R 12/77* (2011.01)
*H01R 12/72* (2011.01)
*H01R 12/88* (2011.01)

(52) U.S. Cl.
CPC ..... *H01R 12/774* (2013.01); *H01R 12/721* (2013.01); *H01R 12/88* (2013.01)

(58) Field of Classification Search
CPC ..... H01R 12/592; H01R 12/79
USPC ..... 439/494, 495, 260, 262
See application file for complete search history.

(56) References Cited

U.S. PATENT DOCUMENTS 6,726,497 B2 * 4/2004 Nogawa ..... H01R 12/88 439/260
9,093,795 B2 * 7/2015 Ashibu ..... H01R 12/7011
9,112,306 B2 * 8/2015 Kiyooka ..... H01R 12/88
9,190,757 B2 * 11/2015 Kiyooka ..... H01R 12/778
2007/0077809 A1 * 4/2007 Takashita ..... H01R 13/629 439/492
2012/0258618 A1 * 10/2012 Sasaki ..... H01R 12/78 439/260

(Continued)

FOREIGN PATENT DOCUMENTS

JP 2011-222273 11/2011

OTHER PUBLICATIONS

U.S. Appl. No. 15/191,643 to Katsutoshi Tojo, which was filed on Jun. 24, 2016.

*Primary Examiner* — Tulsidas C Patel
*Assistant Examiner* — Marcus Harcum
(74) *Attorney, Agent, or Firm* — Greenblum & Bernstein, P.L.C.

(57) ABSTRACT

A connector includes a first terminal accommodated in a first housing portion of a housing and a holding terminal accommodated in a second housing portion of the housing. The holding terminal is identical in shape to the first terminal and is configured to hold a cable. The first terminal has a contact point configured to come into contact with the cable. The holding terminal has a holding part corresponding in position to the contact point of the first terminal. When the housing is oriented so that the direction of inserting and removing the cable is horizontal, the holding part of the holding terminal accommodated in the second housing portion differs in position in height from the contact point of the first terminal accommodated in the first housing portion.

8 Claims, 19 Drawing Sheets

(56) References Cited

U.S. PATENT DOCUMENTS

2013/0309887 A1* 11/2013 Honda ..... H01R 12/88
439/260

* cited by examiner

CONNECTOR AND CONNECTOR ASSEMBLY INCLUDING THE SAME

BACKGROUND

1. Technical Field

The present disclosure relates to a connector and a connector assembly including it.

2. Description of the Related Art

A well-known conventional connector includes a plurality of contacts, a housing, and a lever. These contacts come into contact with a plurality of conductors contained in a planar cable, such as a flexible printed circuit (FPC) or a flexible flat cable (FFC). The housing accommodates the contacts. The lever is attached to the housing so as to be capable of turning.

This connector includes a locking mechanism for preventing the cable inserted in the housing from coming off. More specifically, the cable has locking holes at both ends in the width direction, whereas the housing includes holding terminals having locking projections at both ends in the width direction. The locking projections are inserted into and engaged with the locking holes so as to prevent the cable from coming off the housing.

SUMMARY

The present disclosure provides a connector which is low in cost and unlikely to cause a cable to come off it, and a connector assembly including the connector.

The connector of the present disclosure includes a housing, a first terminal, and a holding terminal. The housing includes a first housing portion and a second housing portion, and is configured such that a planar cable is to be inserted thereinto. The first terminal is accommodated in the first housing portion and is to be conductively connected to the cable. The holding terminal is accommodated in the second housing portion and is configured to hold the cable. The first terminal is identical in shape to the holding terminal, and has a contact point configured to come into contact with the cable. The holding terminal has a holding part which corresponds in position to the contact point of the first terminal and is configured to hold the cable. When the housing is oriented so that the direction of inserting and removing the cable is horizontal, the holding part of the holding terminal accommodated in the second housing portion differs in position in height from the contact point of the first terminal accommodated in the first housing portion.

The connector with the above structure is low in cost and unlikely to cause the cable to come off it.

DETAILED DESCRIPTION OF THE PREFERRED EMBODIMENTS

Problems associated with the conventional connector will be briefly described prior to describing the exemplary embodiment of the present disclosure. In the above-described conventional connector, the holding terminals at both ends in the width direction of the housing are components different from the contacts, and hence, the cost increases. It would be possible to use some of the contacts as the holding terminals. The mere use of contacts as the holding terminals, however, would not allow the holding terminals to temporarily hold the cable, possibly causing the cable to come off the connector.

Figure 1:
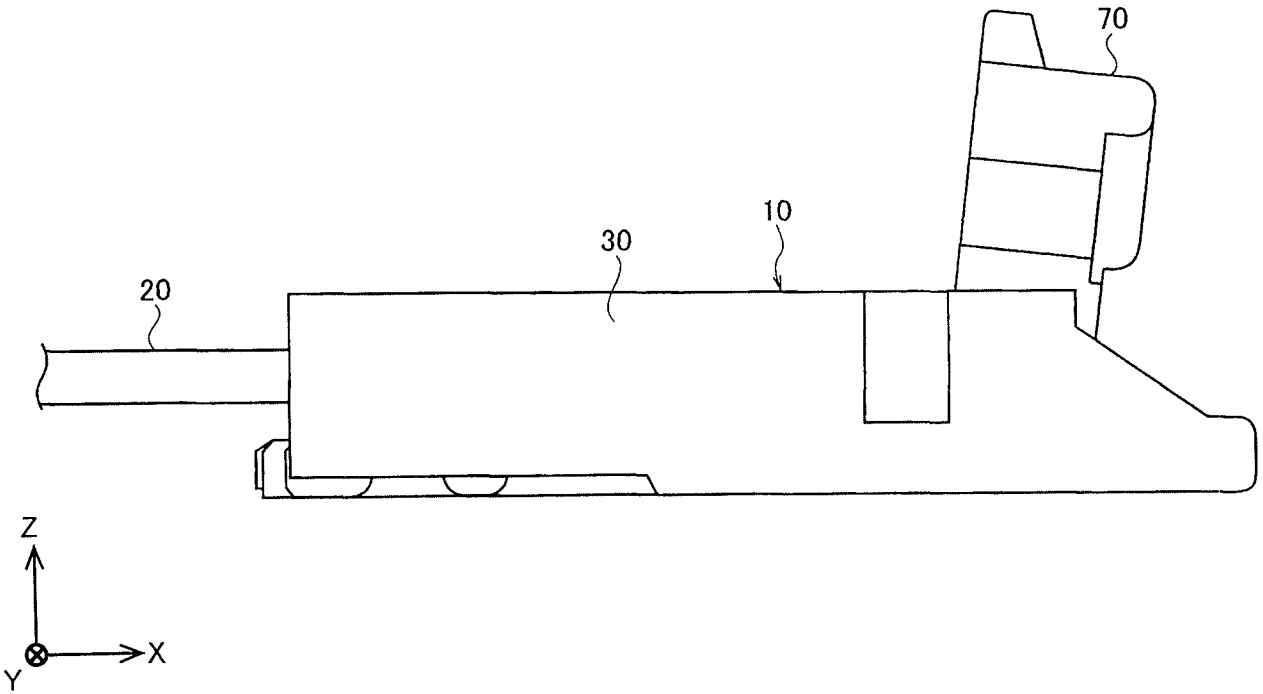
FIG. 1 is a side view showing a connector and a cable according to an exemplary embodiment of the present disclosure.
Figure 2:
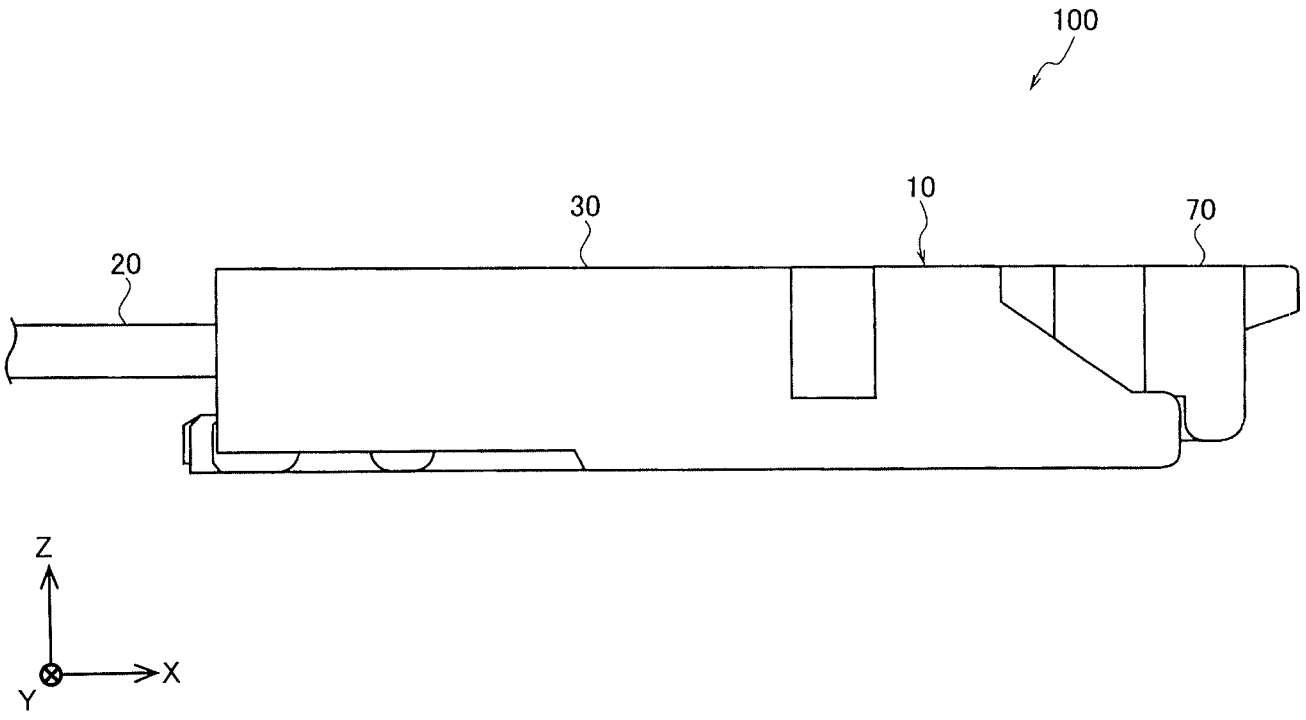
FIG. 2 is a side view of a connector assembly according to the exemplary embodiment of the present disclosure.
Figure 3:
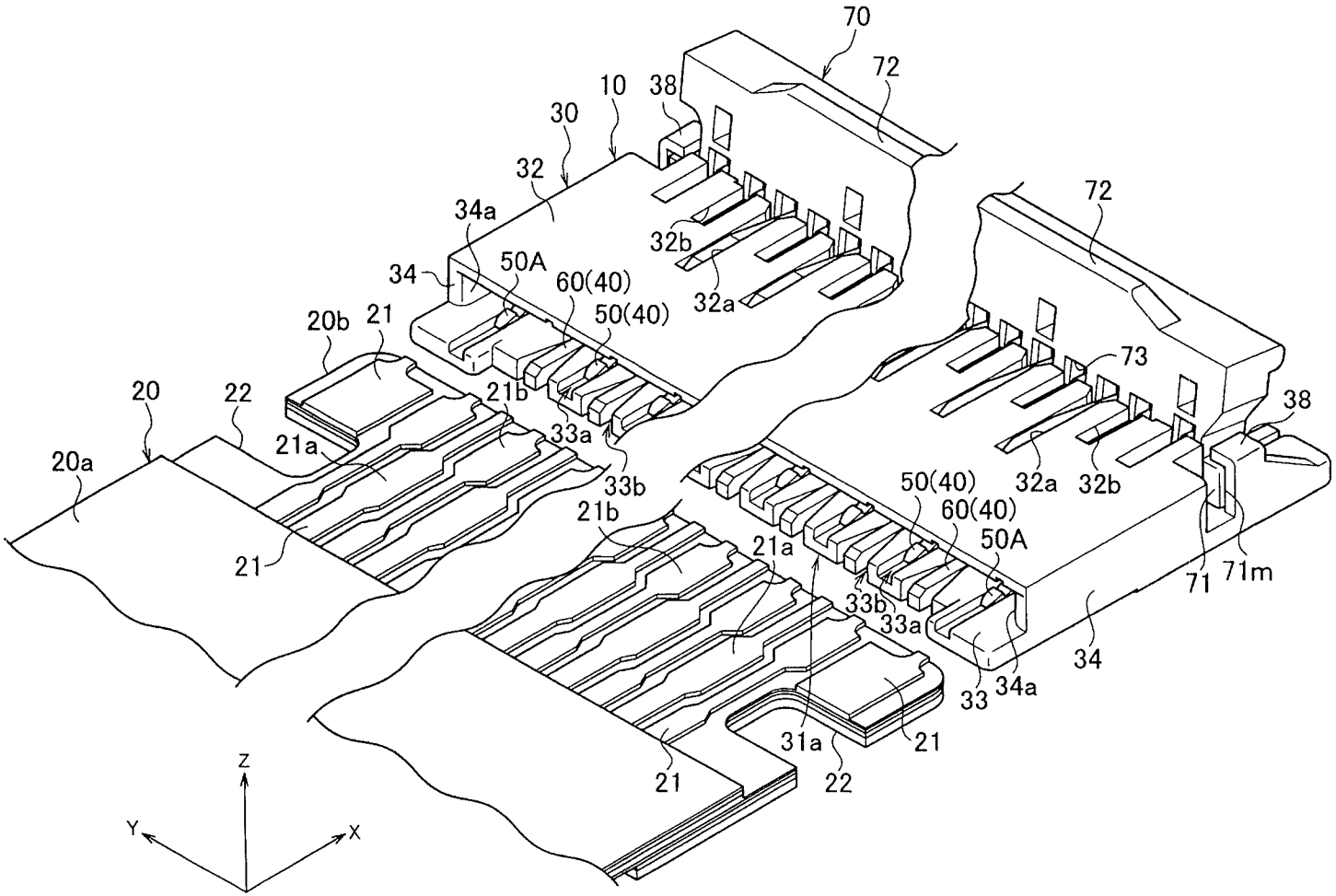
FIG. 3 is a perspective view of the connector and the cable shown in FIG. 1.
Figure 4:
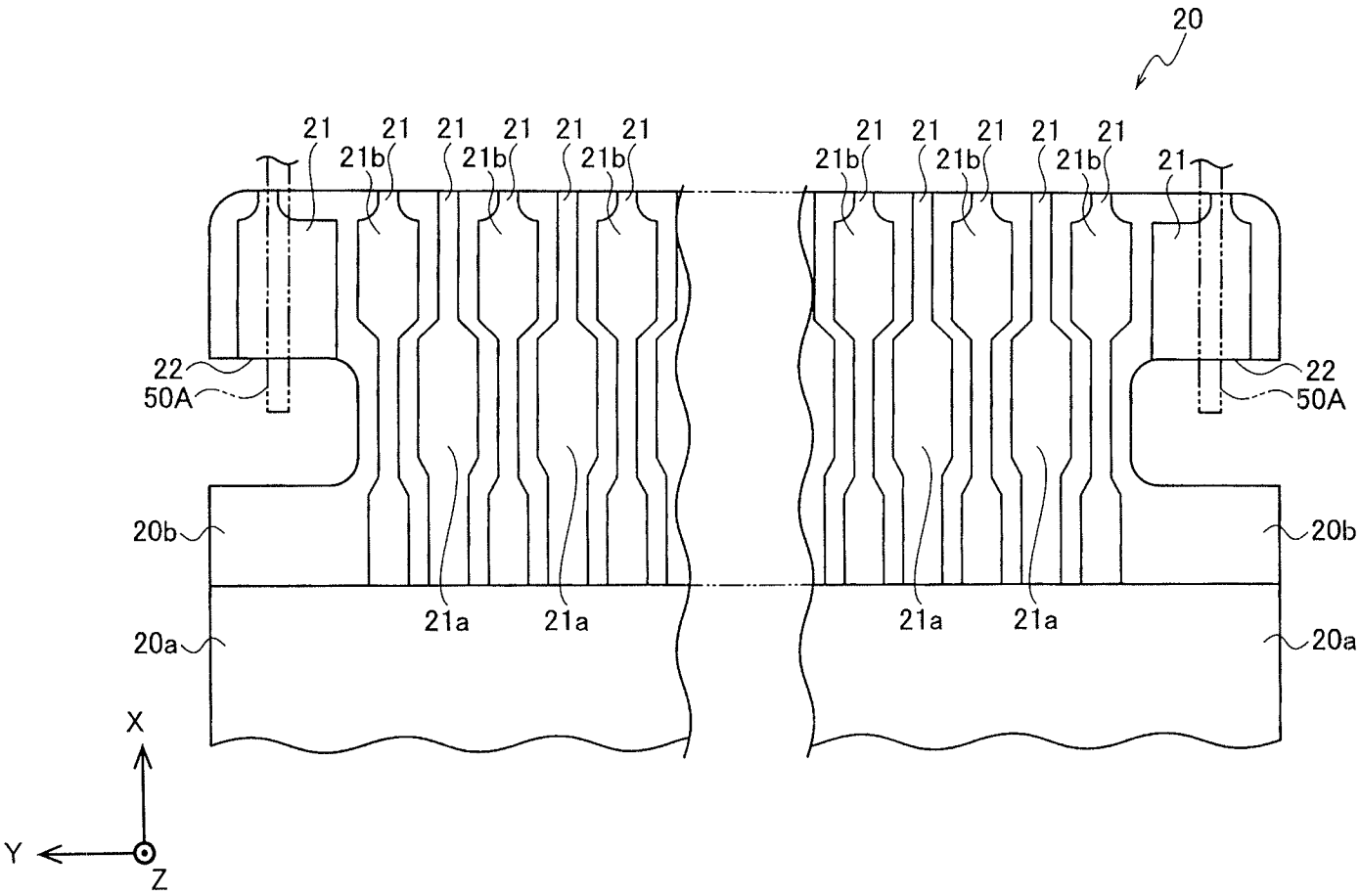
FIG. 4 is a plan view of the cable shown in FIG. 3.
Figure 5:
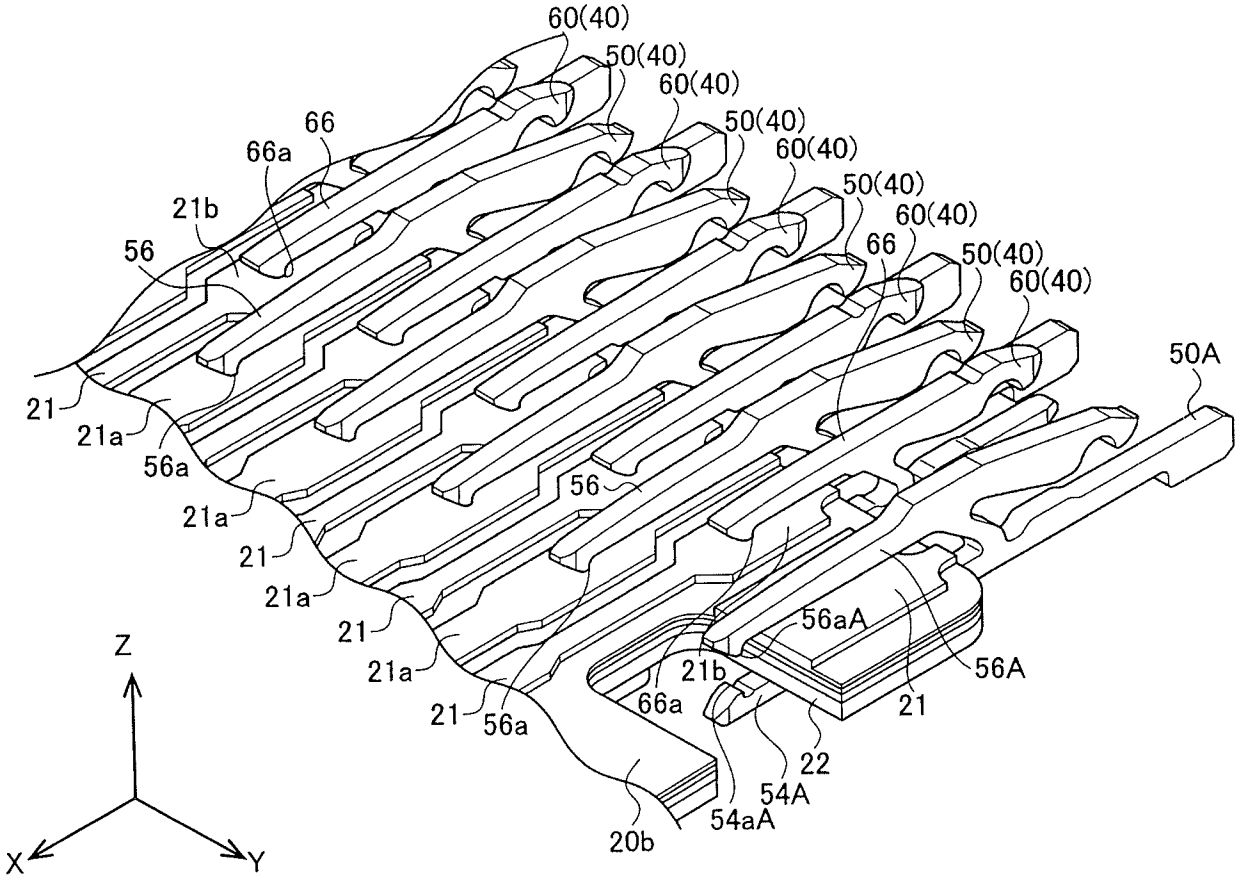
FIG. 5 is a perspective view showing the positional relationship between the cable and terminals and that between the cable and a holding terminal when the cable is inserted in a housing of the connector according to the exemplary embodiment of the present disclosure.

The exemplary embodiment of the present disclosure will now be described in detail with reference to drawings. FIG. 1 is a side view of connector 10 and cable 20 according to the exemplary embodiment of the present disclosure. FIG. 2 is a side view of connector assembly 100 according to the exemplary embodiment of the present disclosure. FIG. 3 is a perspective view of connector 10 and cable 20. FIG. 4 is a plan view of cable 20 shown in FIG. 3. FIG. 5 is a perspective view showing the positional relationship between cable 20 and terminals (contacts) 40 and that between cable 20 and holding terminal 50A when cable 20 is inserted in housing 30 of connector 10.

Connector 10 includes insulating housing 30, terminals 40, and lever 70. Housing 30 is configured such that cable 20 is to be inserted thereinto. Cable 20 has a sheet-like (planar) shape with front and back sides, specifically such as an FPC or an FFC. Terminals 40 are accommodated in housing 30 and configured to be conductively connected to cable 20. Lever 70 is attached to housing 30 in such a manner as to turn between an open position (shown in FIG. 1) and a closed position (shown in FIG. 2). When lever 70 is in the open position as a first position, cable 20 can be inserted into housing 30. When lever 70 is in the closed position as a second position, cable 20 is held in housing 30.

In the following description, the direction of inserting and removing cable 20 is defined as a back-and-forth direction X, the longitudinal direction of housing 30 is defined as a width direction Y, and the thickness direction of housing 30 is defined as a vertical direction Z. The width direction Y is the direction in which terminals 40 are aligned, and is also the direction in which pivot shafts 71 as the turning shafts of lever 70 extend. The direction Y is orthogonal to the direction of inserting and removing cable 20 and also to the thickness direction of cable 20. The vertical direction Z is also the thickness direction of inserted cable 20.

In the following description, the direction in which cable 20 is removed from housing 30 will be referred to as the front side, and the direction in which cable 20 is inserted into housing 30 will be referred to as the rear side. In short, the term "the front side" means the side of housing 30 on which cable 20 is located, and the term "the rear side" means the side of housing 30 on which lever 70 is located. In other words, the positive direction in the direction X is referred to as "the rear side", and the negative direction in the direction X is referred to as "the front side". The vertical direction is defined with reference to the state in which connector 10 is oriented so that lever 70 is attached to housing 30 above it.

Planar cable 20 includes body 20*a* and insertion end 20*b* adjoining to the rear end of body 20*a*. On insertion end 20*b*, a plurality of conductors 21 are exposed at a predetermined pitch in the width direction Y. The portions of conductors 21 that are brought into contact with the contact points of terminals 40 (the portions with a wide width in the direction Y) are alternately staggered (arranged in zigzag manner) (see FIGS. 3-5).

Conductors 21 are patterned as shown in FIG. 4 to have substantially the same shape on the front and rear sides of insertion end 20*b*. Basically, conductors 21 are electrically connected to the respective conductors (not shown) contained in body 20*a*.

As shown in FIGS. 3 and 5, a plurality of first terminals 50 and a plurality of second terminals 60 are arranged in housing 30 at a predetermined pitch in the width direction Y. Terminals 50 and 60 are configured to be conductively connected to conductors 21 of cable 20, respectively.

Thus, in the present exemplary embodiment, terminals 40 include first terminals 50 and second terminals 60. Terminals 50 and 60 are substantially aligned in the width direction (longitudinal direction) Y of housing 30 and configured to be conductively connected to conductors 21. Thus, terminal group 40G used for signal transmission is formed.

In the present exemplary embodiment, the wide-width portions of conductors 21 are composed of wide-width parts 21*a* located on the front part (close to body 20*a*) and wide-width parts 21*b* located on the rear part (close to the tip). Each of wide-width parts 21*a* is brought into contact with the contact points (fixed contact point 54*a* and movable contact point 56*a*) of first terminal 50. Each of wide-width parts 21*b* is brought into contact with the contact points (fixed contact point 64*a* and movable contact point 66*a*) of second terminal 60. In the following, fixed contact points 54*a* and movable contact points 56*a* will be sometimes abbreviated as contact points 54*a* and 56*a*, respectively, and fixed contact points 64*a* and movable contact points 66*a* will be sometimes abbreviated as contact points 64*a* and 66*a*, respectively.

Housing 30 further includes holding terminals 50A at both sides in the width direction Y. More specifically, each of holding terminals 50A is located at each side of terminal group 40G in the width direction Y. As a result, terminals 40 (first terminals 50 and second terminals 60) composing terminal group 40G and holding terminals 50A are substantially aligned. In the present exemplary embodiment, the distance from holding terminals 50A to terminal group 40G is larger than the above-mentioned predetermined pitch. The predetermined pitch is the distance between adjacent pairs of terminals 50 and 60 in the width direction Y in terminals 40 composing terminal group 40G.

Cable 20 is provided with holding holes 22 at both ends in the width direction Y. Holding holes 22 are open toward the outside in the width direction Y like notches (or cutouts) and penetrate in the thickness direction. Holding holes 22 correspond in position to after-mentioned fixed holding parts 54*a*A of holding terminals 50A when cable 20 is inserted in housing 30.

When cable 20 is inserted into housing 30, holding parts 54*a*A of holding terminals 50A are locked into holding holes 22 of cable 20. As a result, cable 20 inserted in housing 30 is prevented from coming off (see FIGS. 5 and 18).

As described above, insulating lever 70 is attached to housing 30 so as to be capable of turning. More specifically, lever 70 is attached to housing 30 in such a manner as to turn between the open position (shown in FIG. 1) in which cable 20 can be inserted into housing 30 and the closed position (shown in FIG. 2) in which cable 20 inserted in housing 30 is held by first terminals 50 and second terminals 60.

Housing 30 is made of an insulating material such as synthetic resin and includes bursiform cable reception part 31, into which cable 20 is inserted from the front side. Cable reception part 31 is located at the front of housing 30 in the back-and-forth direction X and substantially in the middle in the vertical direction Z. The front of housing 30 in the direction X corresponds to the left side in FIGS. 11A, 12-15A, and 16, and also corresponds to the removing side in the direction of inserting and removing cable 20.

Figure 11A:
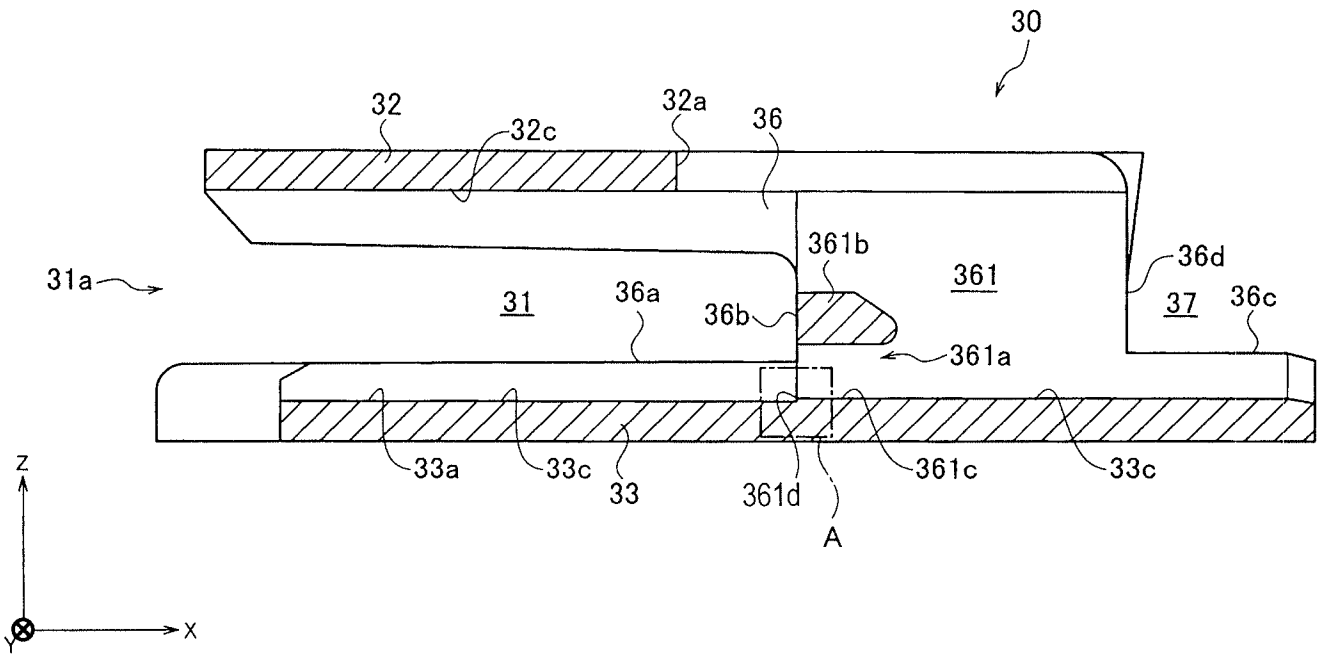
FIG. 11A is a sectional view of a first-terminal housing portion (first housing portion) of the housing according to the exemplary embodiment of the present disclosure.

Cable reception part 31 is in the form of a flat rectangular prism extending in the lateral direction. The rectangular prism is composed of top wall part 32 and bottom wall part 33 shown in FIG. 11A, two side wall parts 34 shown in FIGS. 3 and 8, and back wall parts 35 shown in FIG. 8. Side wall parts 34 are located at both ends of the front of housing 30 in the width direction Y. Back wall parts 35 are adjoining to the rear ends of side wall parts 34, respectively. Cable reception part 31 has an opening toward the front side. In other words, as shown in FIG. 11A and the like, cable reception part 31 is like a bag with insertion opening 31*a* toward the front side. Insertion opening 31*a* has an opening area large enough to accommodate planar cable 20. In other words, the vertical length of opening 31*a* is slightly larger than the thickness of cable 20, and the lateral length of opening 31*a* is also slightly larger than the width of cable 20.

In housing 30, it is only required that top wall part 32 and bottom wall part 33 form the top and bottom, respectively, of cable reception part 31. The side walls of cable reception part 31 may be composed of a different material from both ends of housing 30 in the width direction Y, such as a metal or resin plate.

Figure 8:
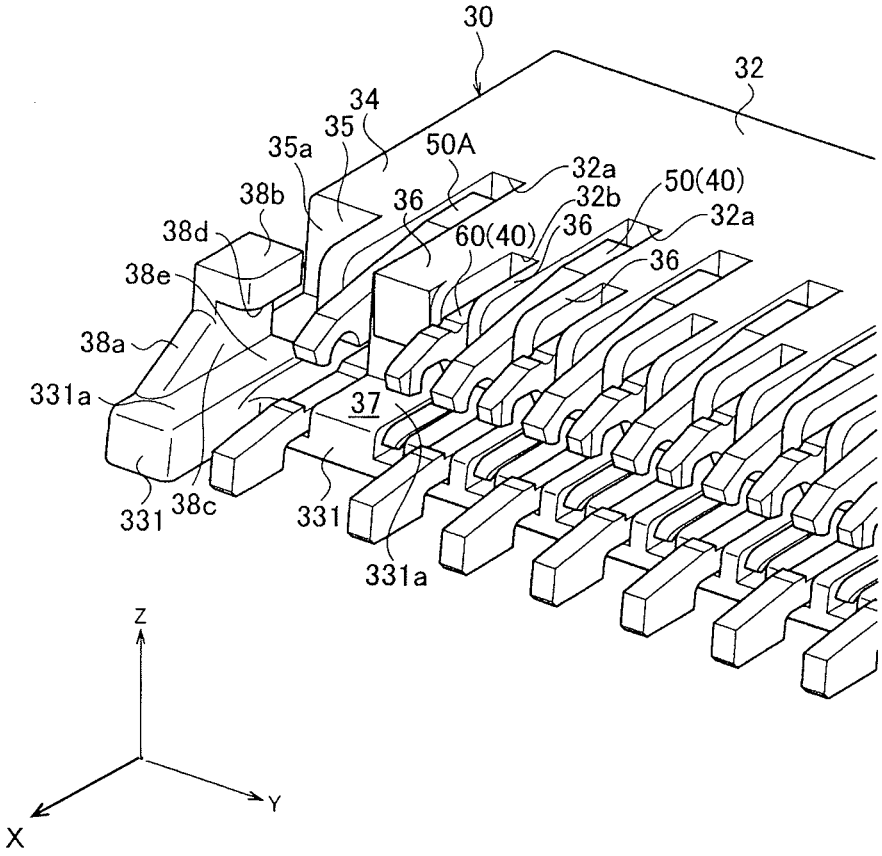
FIG. 8 is a partial perspective view of the connector of FIG. 7 when the lever is detached from it.

As shown in FIG. 8, bottom wall part 33 has, at its rear, extended parts 331 extending further backward than back surfaces 35*a* of back wall parts 35. Extended parts 331 have top surfaces 331*a* on which lever attaching part 37 is formed. Lever 70 is attached to lever attaching part 37 so as to be capable of turning.

Figure 6:
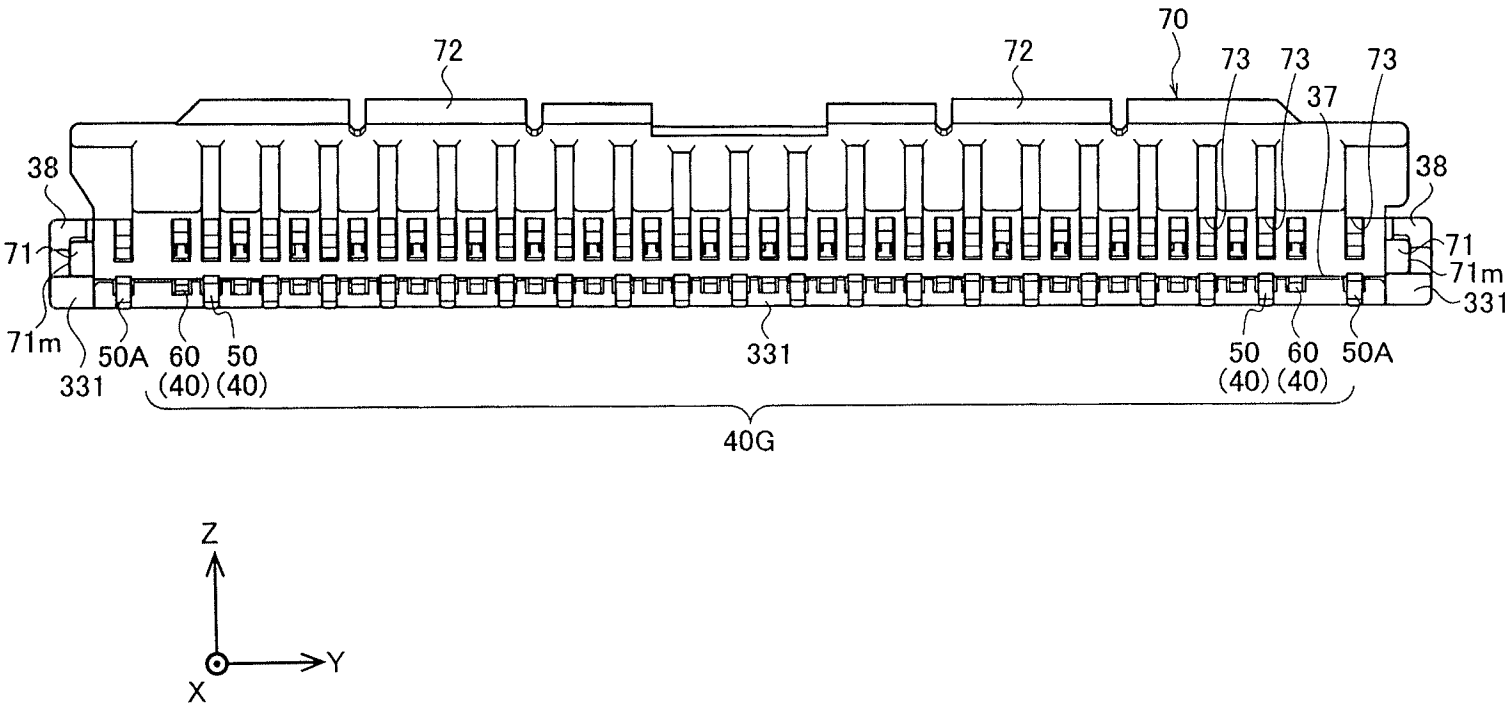
FIG. 6 is a front view of the connector of FIG. 3 when seen from the lever side.
Figure 7:
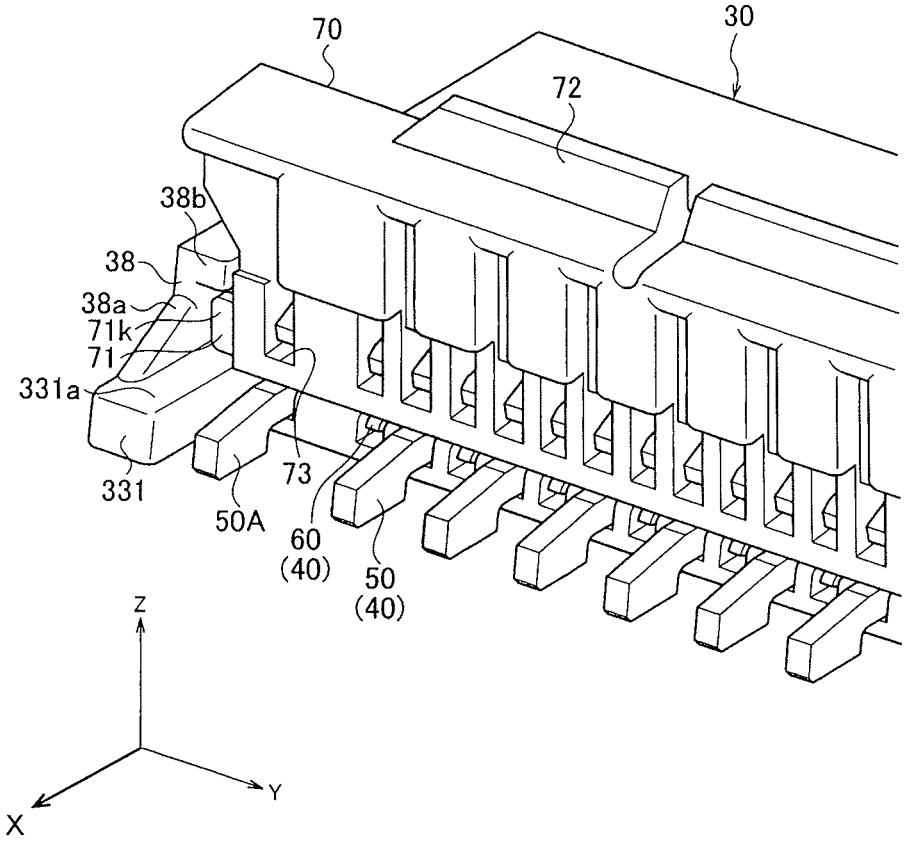
FIG. 7 is a partial perspective view of the connector of FIG. 3 when seen from the lever side.

Lever 70 is in the shape of a plate made of an insulating material such as synthetic resin and can be accommodated in lever attaching part 37 of housing 30. As shown in FIGS. 6 and 7, lever 70 includes operating part 72 for opening and closing lever 70. Operating part 72 is the body of lever 70.

Pivot shafts 71 as attachment parts or as turning shafts are formed at both ends of lever 70 in the width direction Y. Pivot shafts 71 are attached to bearings 38 formed as supporting parts in housing 30, so that lever 70 can be attached to lever attaching part 37 so as to be capable of turning. As described above, the width direction Y is also the direction in which pivot shafts 71 extend.

More specifically, bearings 38 are formed on both sides of lever attaching part 37 in the width direction Y in such a manner as to be open to the inside in the width direction Y as well as to both sides in the back-and-forth direction X. Bearings 38 oppose each other in the width direction Y of housing 30. More specifically, two bearings 38 are formed so that inner surfaces 38*c* of after-mentioned vertical wall parts 38*a* oppose each other in the width direction Y of housing 30.

Meanwhile, as shown in FIGS. 3 and 7, pivot shafts 71 protrude toward proximal sides of the both end faces of lever 70 in the width direction Y.

As described above, pivot shafts 71 are located at both ends of lever 70 in the width direction Y, and bearings 38 are located on both ends of housing 30 in the width direction Y. Pivot shafts 71 are attached to bearings 38 from above housing 30 and are supported by bearings 38. Thus, lever 70 is pivotably (openably and closably) attached to lever attaching part 37 of housing 30 (see FIGS. 3, 7, and 8). Pivot shafts 71 are formed integrally with operating part 72 and configured to turn with lever 70 when lever 70 is turned from the open position to the closed position.

If pivot shafts 71 were merely supported by bearings 38, lever 70 might turn from the open position to the closed position in a state that cable 20 is not inserted in housing 30. This could happen, for example, when someone touches lever 70, or in the case that circuit boards (not shown) are stacked on connector 10. More specifically, if configured to turn smoothly from the open position to the closed position, lever 70 might do so in a state that cable 20 is not inserted in housing 30. This is what is called the "defective closing" of lever 70. The defective closing of lever 70 might occur, for example, if cylindrically projected pivot shafts were supported by bearings. This may result in plastic deformation of terminals 40.

To avoid such consequences, in the present exemplary embodiment, either bearings 38 or pivot shafts 71, or both of them include defective-closing prevention structure 80 for preventing lever 70 from turning from the open position to the closed position when cable 20 is not in housing 30.

More specifically, as shown in FIGS. 7 and 8, bearing 38 is substantially in the shape of the letter U, which has the end of extended part 331 in the width direction Y, vertical wall part 38*a*, and upper wall part 38*b*. Vertical wall part 38*a* extends upward from the end of extended part 331 in the width direction Y. Upper wall part 38*b* extends inward in the width direction Y from the upper end of vertical wall part 38*a*.

Bearing 38 has an inner surface opposing outer peripheral face 71*k* of the corresponding pivot shaft 71 when shaft 71 is supported by bearing 38.

Figure 9A:
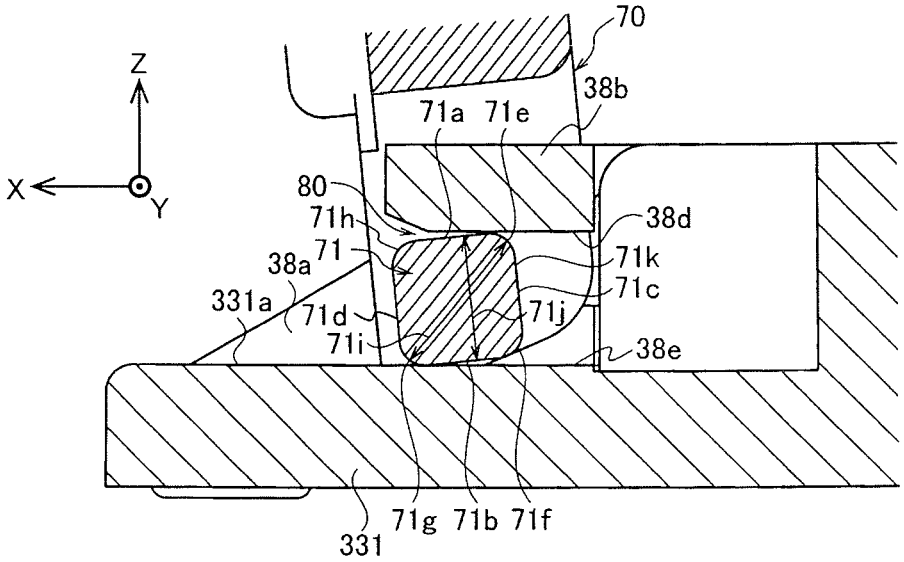
FIG. 9A is a sectional view showing a state that a pivot shaft of the lever of the connector according to the exemplary embodiment of the present disclosure is supported by a bearing.

In the present exemplary embodiment, as shown in FIG. 9A, when pivot shaft 71 is supported by substantially U-shaped bearing 38, top surface 331*a* at the end of extended part 331 in the width direction Y-functions as a first inner surface 38*e*. Inner surface 38*e* is a part of inner surface of bearing 38 opposing outer peripheral face 71*k* of pivot shaft 71. Furthermore, upper wall part 38*b* has bottom surface 38*d*, which is away from and opposite to first inner surface 38*e* and functions as a second inner surface. The second inner surface is a part of the inner surface of bearing 38 opposing outer peripheral face 71*k* of pivot shaft 71. As shown in FIGS. 3, 7, and 8, inner surface 38*c* of vertical wall part 38*a* of bearing 38 functions as the bearing surface to receive end face 71*m* of the corresponding pivot shaft 71.

As described above, in the present exemplary embodiment, bearing 38 includes extended part 331 whose top surface 331*a* (first inner surface 38*e*) is a part of the inner surface that opposes outer peripheral face 71*k* of the corresponding pivot shaft 71. Bearing 38 further includes upper wall part 38*b* whose bottom surface (second inner surface) 38*d* is a part of the inner surface. The bottom surface 38*d* is away from and opposite to top surface 331*a* (first inner surface 38*e*) of extended part 331.

Thus, the end of extended part 331 in the width direction Y is a first wall part having first inner surface 38*e* as a part of the inner surface opposing outer peripheral face 71*k* of the corresponding pivot shaft 71. Meanwhile, upper wall part 38*b* is a second wall part having the second inner surface as a part of the inner surface opposing outer peripheral face 71*k* of the corresponding pivot shaft 71. The second inner surface is away from and opposite to first inner surface 38*e*.

Upper wall part 38*b* as the second wall part is cantilever-supported at the end of the corresponding extended part 331 in the width direction Y as the first wall part and is also elastically deformable against the first wall part. It is only required that at least one of extended part 331 as a part of the first wall part and upper wall part 38*b* as the second wall part be elastically deformable.

As shown in FIG. 9A, pivot shaft 71 has a cross section of a substantial square in the x-z plane. The x-z plane is orthogonal to the direction Y in which pivot shafts 71 extend. The substantial square means that two pairs of parallel sides extend at right angles to each other and the corners are chamfered with curves.

When the back-and-forth direction and the vertical direction are defined in shown in FIG. 9A, outer peripheral face 71*k* of pivot shaft 71 has four flat faces: top face 71*a*, bottom face 71*b*, front face 71*c*, and back face 71*d*.

When lever 70 is in the open position, one side (one flat face) of pivot shaft 71 opposes bottom surface 38*d* of upper wall part 38*b* of bearing 38, and as shown in FIG. 6, pivot shafts 71 project from the proximal sides of the both end faces of lever 70 in the width direction Y. In other words, when lever 70 is in the open position, two flat faces of pivot shaft 71 extend substantially horizontally at the top and bottom, respectively, of pivot shaft 71. In FIG. 9A, the two flat faces correspond to top face 71*a* and bottom face 71*b*.

Top face 71*a* and front face 71*c* meet at front-upper vertex 71*e*, and front face 71*c* and bottom face 71*b* meet at front-lower vertex 71*f*. Bottom face 71*b* and back face 71*d* meet at back-lower vertex 71*g*, and back face 71*d* and top face 71*a* meet at back-upper vertex 71*h*.

Pivot shaft 71 with the above-described configuration has wide-width part 71*i* and narrow-width part 71*j* smaller in width than wide-width part 71*i* in the direction orthogonal to the width direction Y. In short, narrow-width part 71*j* is smaller in width than wide-width part 71*i* in the direction orthogonal to the width direction Y.

More specifically, in pivot shaft 71, wide-width parts 71*i* are diagonals (between front-upper vertex 71*e* and back-lower vertex 71*g*, and between front-lower vertex 71*f* and back-upper vertex 71*h*), whereas narrow-width parts 71*j* are the parts between opposing faces (between top face 71*a* and bottom face 71*b*, for example).

Figure 9B:
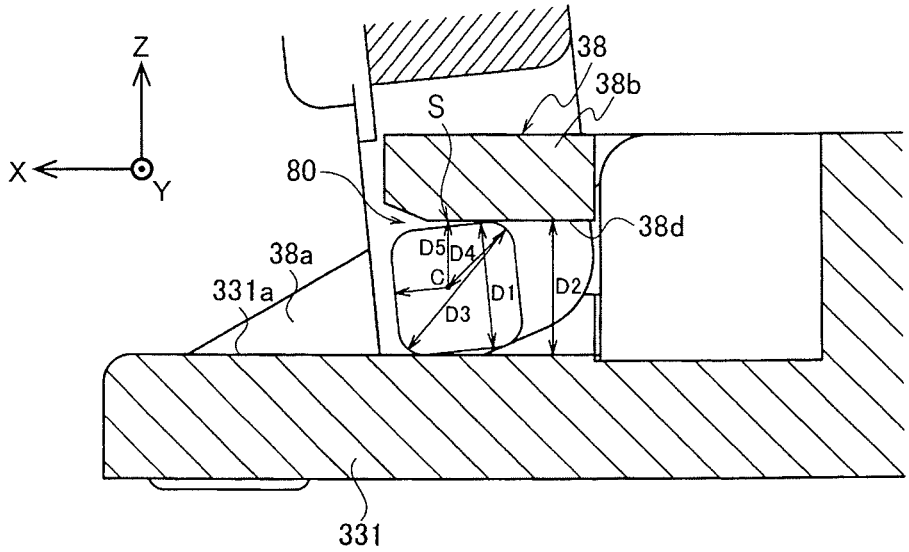
FIG. 9B is a diagram showing the relationship between the pivot shaft and the bearing in the state shown in FIG. 9A.

As shown in FIGS. 9A and 9B, each of narrow-width parts 71*j* has a width D1, which is smaller than a width D2. The width D2 is a width of the inner surface of each bearing 38. The width D1 is the distance from top face 71*a* to bottom face 71*b*, or in other words, the length of one side of the cross section of pivot shaft 71. The width D2 is the distance from first inner surface 38*e* to bottom surface 38*d* as the second inner surface.

Wide-width parts 71*i* of pivot shaft 71 have a width D3 larger than the width D2 of the inner surface of bearing 38. The width D3 is the distance from front-upper vertex 71*e* to back-lower vertex 71*g*, or in other words, the length of each diagonal of the cross section of pivot shaft 71.

During the turn of lever 70 from the open position to the closed position, parts of the outer peripheral face that are located at both ends of one of wide-width parts 71*i* in pivot shaft 71 come into sliding contact with the inner surfaces of corresponding bearing 38. More specifically, back-lower vertex 71*g*, which is one end of wide-width part 71*i* comes into sliding contact with first inner surface 38*e*, whereas front-upper vertex 71*e*, which is the other end comes into sliding contact with bottom surface 38*d*, which is the second inner surface.

In the present exemplary embodiment, pivot shafts 71 and bearings 38 are configured as described above so as to form defective-closing prevention structure 80 for preventing lever 70 from turning from the open position to the closed position when cable 20 is not inserted in housing 30.

When lever 70 is turned from the open position to the closed position, pivot shafts 71 turn about a turn center C (see FIG. 9B).

Pivot shaft 71 has a most distant point and a least distant point from the turn center C. In the present exemplary embodiment, in the cross section shown in FIGS. 9A and 9B, the most distant point is front-upper vertex 71*e*, whereas the least distant point is the intersection of back face 71*d* and a straight line including the turn center C and orthogonal to back face 71*d*. Three dimensionally, the most distant point is a straight line passing through front-upper vertex 71*e* and parallel to the turn center C, whereas the least distant point is the line of intersection of back face 71*d* and a plane including the turn center C and orthogonal to back face 71*d*.

Bottom surface 38*d* of upper wall part 38*b*, which is the second inner surface as a part of the inner surface of bearing 38 is referred to as a counter region, which opposes the most distant point (front-upper vertex 71*e*) of pivot shaft 71 when lever 70 is turned from the open position to the closed position. Bottom surface 38*d* as the counter region contains a region nearest from the turn center C, and this region is referred to as a nearest region S. The nearest region S is the line of intersection of bottom surface 38*d* and a plane including the turn center C, and orthogonal to bottom surface 38*d*.

In the present exemplary embodiment, bearing 38 is configured so that the region opposing the most distant point (front-upper vertex 71*e*) during the turn of lever 70 from the open position to the closed position can be the nearest region S.

Furthermore, a distance D4 from the turn center C to the most distant point (front-upper vertex 71*e*) is made larger than a distance D5 from the turn center C to the nearest region S.

With the above-described structure, during the turn of lever 70 from the open position to the closed position, the most distant point (front-upper vertex 71*e*) in pivot shaft 71 comes into sliding contact with the bottom surface (second inner surface) 38*d* of upper wall part 38*b* while back-lower vertex 71*g* and its vicinity is in sliding contact with first inner surface 38*e* in bearing 38. This configuration prevents lever 70 from turning from the open position to the closed position when cable 20 is not inserted in housing 30.

As described above, defective-closing prevention structure 80 enable the region that opposes the most distant point (front-upper vertex 71*e*) during the turn of lever 70 from the open position to the closed position to be the nearest region S. Structure 80 can also be formed under the condition that the distance D4 from the turn center C to the most distant point (front-upper vertex 71*e*) is made larger than the distance D5 from the turn center C to the nearest region S.

In the present exemplary embodiment, pivot shafts 71 and bearings 38 are made of resin, but only their areas of contact are required to be made of resin.

Figure 17:
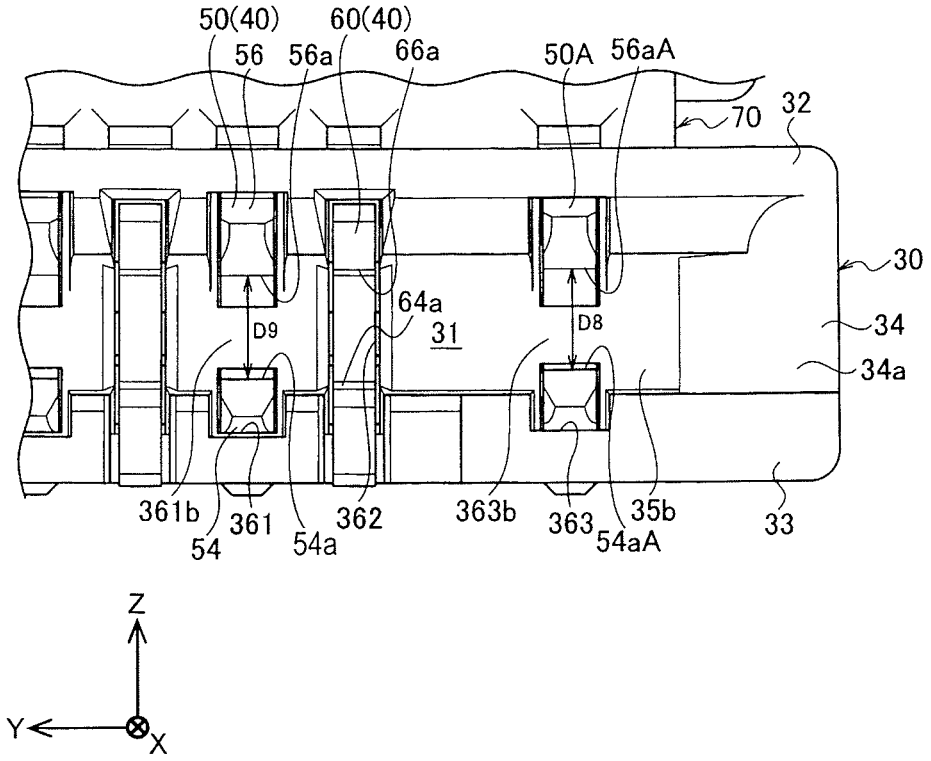
FIG. 17 is a rear view of the second housing portion shown in FIG. 15A with the holding terminal accommodated therein when seen from the insertion opening side of the cable reception part.
Figure 18:
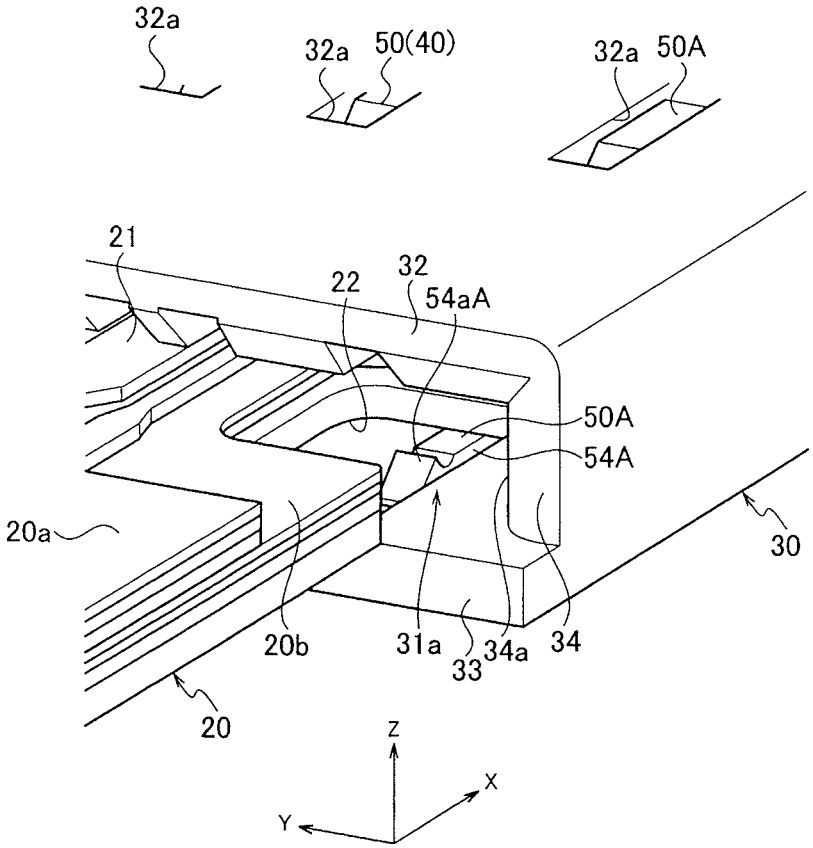
FIG. 18 is a perspective view of the second housing portion shown in FIG. 17 with the holding terminal accommodated therein when seen from the insertion opening side of the cable reception part.

As shown in FIGS. 3, 17, and 18, each of two side wall parts 34 has guide face 34*a* for guiding the insertion of cable 20 at the inside thereof in the width direction Y. As described above, two side wall parts 34 are components of cable reception part 31 into which cable 20 is to be inserted. Guide faces 34*a* are curved inwardly in the width direction Y as approaching to the rear side.

The rear side of cable reception part 31 is formed of back wall parts 35. More specifically, back wall parts 35 have front-side inner surfaces 35*b*, which form the rear sides at both ends of cable reception part 31 of cable 20 in the width direction Y (see FIG. 17).

As described above, lever 70 is attached to housing 30 in such a manner as to turn from the open position shown in FIG. 1 to the closed position shown in FIG. 2.

Figure 12:
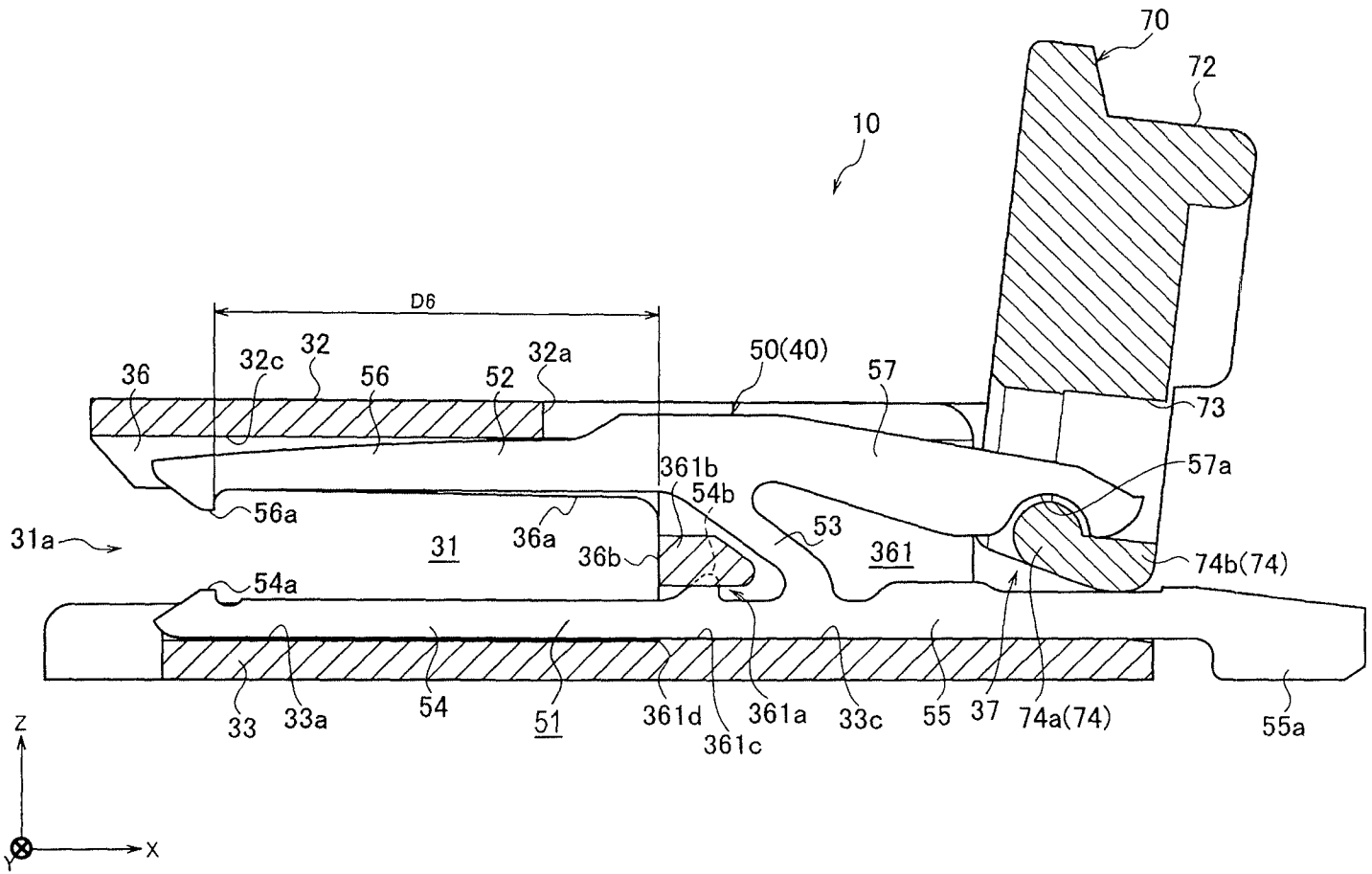
FIG. 12 is a sectional view showing a state that a first terminal is accommodated in the first-terminal housing portion of the housing shown in FIG. 11A.
Figure 14:
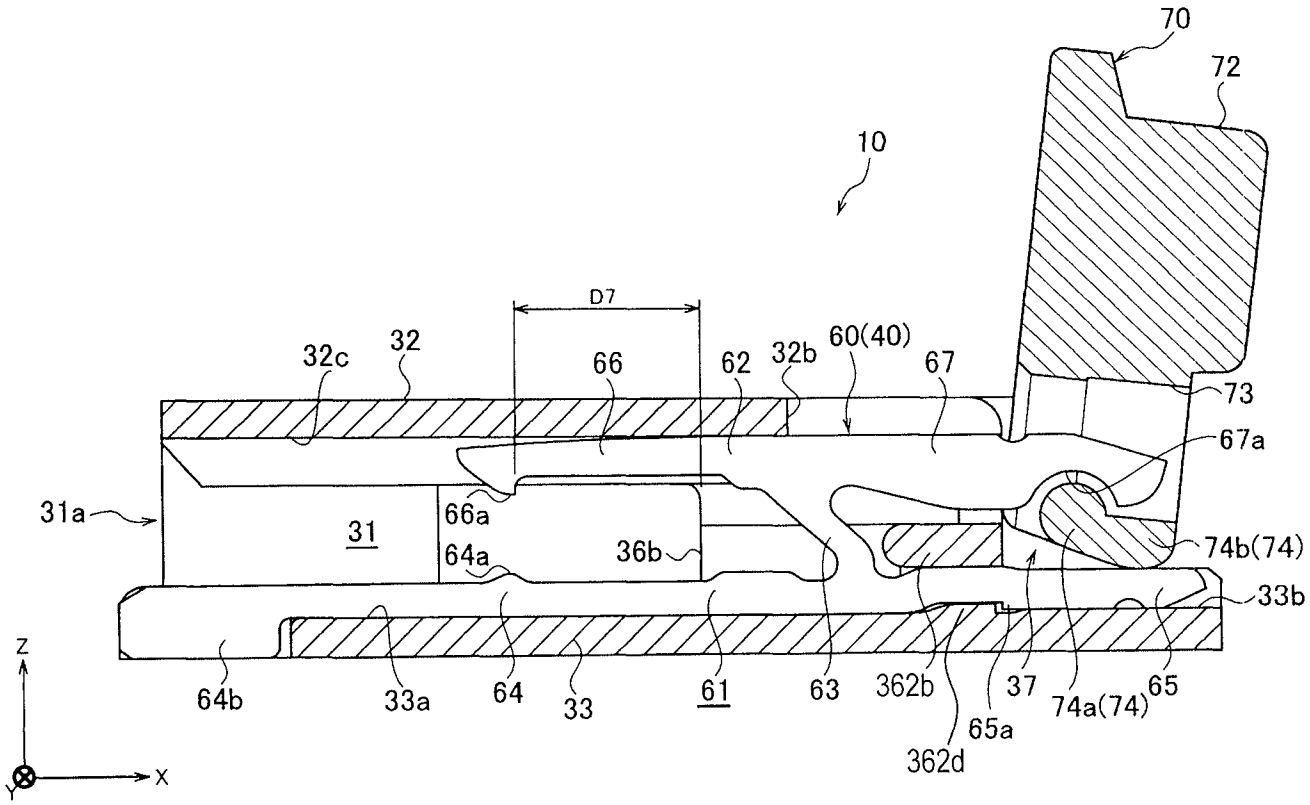
FIG. 14 is a sectional view showing a state that a second terminal is accommodated in the second-terminal housing portion shown in FIG. 13.
Figure 16:
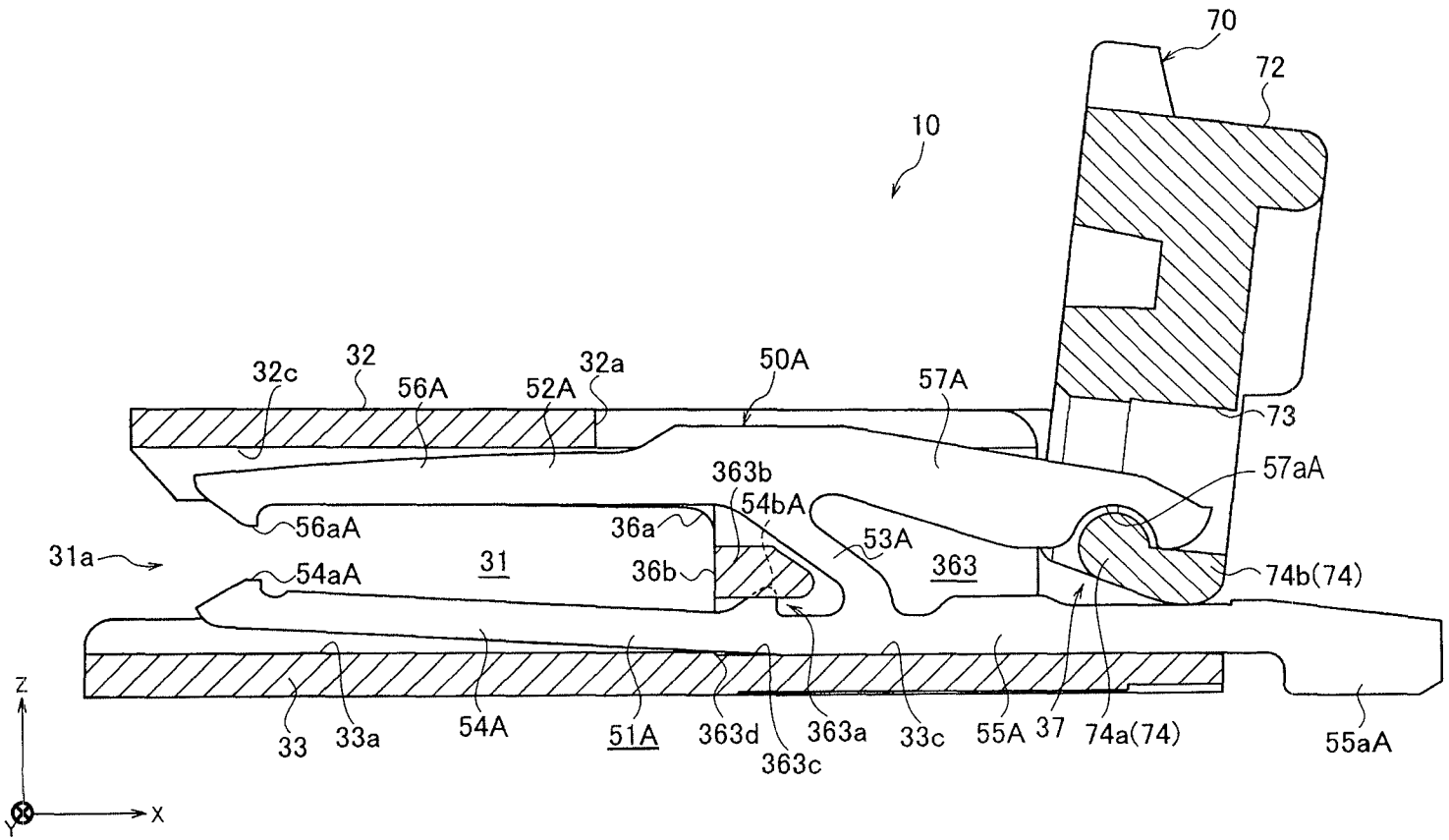
FIG. 16 is a sectional view showing a state that the holding terminal is accommodated in the second housing portion shown in FIG. 15A.

When in the open position, lever 70 rises from lever attaching part 37 of housing 30, so that the substantial rear half portion of lever attaching part 37 is open above housing 30 (see FIGS. 12, 14, and 16). In this condition, cable 20 can be inserted into cable reception part 31 of housing 30.

When in the closed position, lever 70 is substantially horizontal and is accommodated in lever attaching part 37 of housing 30. In this situation, first terminals 50 and second terminals 60 together hold cable 20 inserted in cable reception part 31.

First terminals 50 and second terminals 60, which are aligned in the width direction Y of housing 30, are formed by punching a thin metal sheet metal.

First terminals 50 and second terminals 60 are alternately arranged in the width direction Y of housing 30, and two of second terminals 60 are located at both ends of terminal group 40G in the width direction Y.

First terminals 50 are inserted from the rear side in the back-and-forth direction X and fixed to housing 30 (see FIG. 12). Meanwhile, second terminals 60 are inserted from the front side in the direction X and fixed to housing 30 (see FIG. 14).

Housing 30 includes a plurality of groove-shaped first-terminal housing portions 361 accommodating first terminals 50 and penetrating in the direction X. Housing 30 further includes a plurality of groove-shaped second-terminal housing portions 362 accommodating second terminals 60 and penetrating in the direction X. Housing portions 361 and 362 are alternately arranged in the width direction Y of housing 30. Thus, first-terminal housing portions 361 are first housing portions accommodating first terminals 50. First-terminal housing portions 361 and second-terminal housing portions 362 are terminal housing portions accommodating terminals 40.

Figure 10:
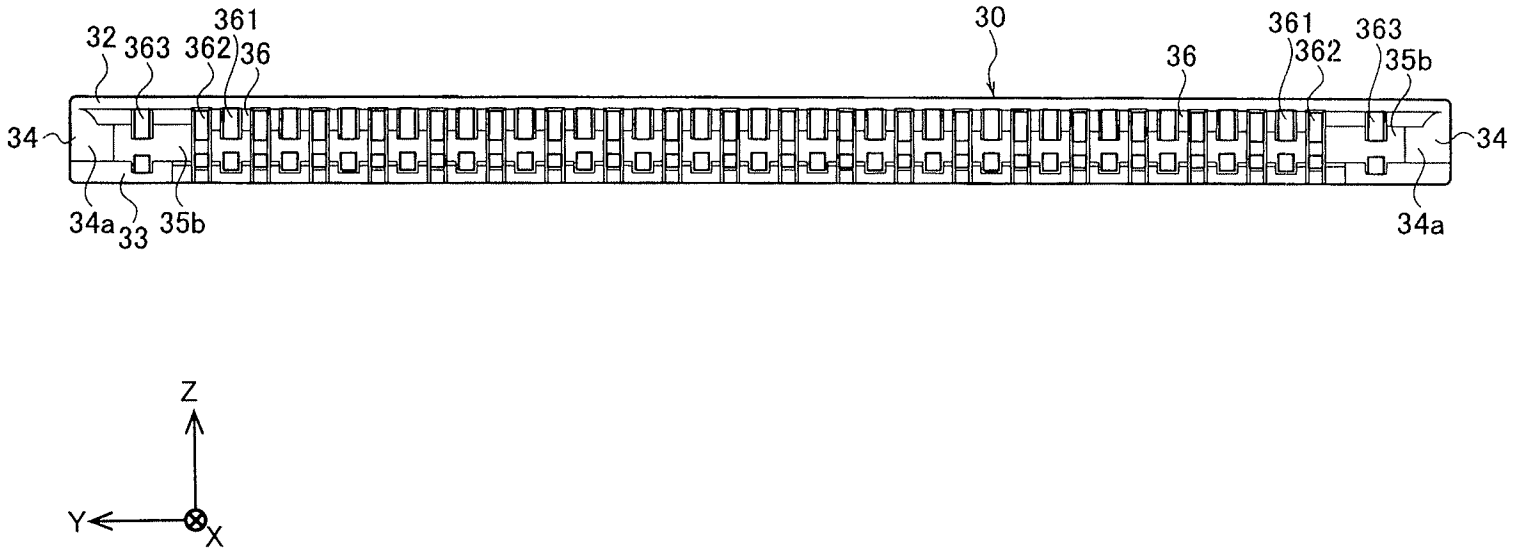
FIG. 10 is a rear view of the housing of the connector according to the exemplary embodiment of the present disclosure when seen from the insertion opening side of a cable reception part of the housing.

First-terminal housing portions 361 and second-terminal housing portions 362 are separated from each other by vertical wall parts 36 shown in FIG. 10 extending in the direction X. More specifically, each of first-terminal housing portions 361 and second-terminal housing portions 362 is formed by two vertical wall parts 36 adjacent in the width direction Y between top wall part 32 and bottom wall part 33 in such a manner as to penetrate in the direction X. Each first terminal 50 is inserted from the rear side into the corresponding first-terminal housing portion 361, and each second terminal 60 is inserted from the front side into the corresponding second-terminal housing portion 362.

As shown in FIGS. 11A-14, each vertical wall part 36 is, in its front part, provided with substantially U-shaped notch 36*a*, which is open forward. Notches 36*a* allow planar cable 20 to be inserted into cable reception part 31 without being hindered by vertical wall parts 36. Each vertical wall part 36 also has back wall surface 36*b* at the back of notch 36*a* (at the back in the direction X) in order to control the movement of cable 20 toward the rear side (toward the insertion direction).

Each vertical wall part 36 has, at its rear, a substantially L-shaped opening backward and upward. In the L-shaped openings of vertical wall parts 36, lower-side front surfaces 36*c* and upper-side back surfaces 36*d* together form lever attaching part 37. Thus, the rear of each vertical wall part 36 is a part of the above-described extended part 331. In other words, lower-side front surface 36*c* of each vertical wall part 36 is a part of top surface 331*a* of extended part 331.

Top wall part 32 is provided with first grooves 32*a* and second grooves 32*b* both extending in the direction X. Bottom wall part 33 is provided with first grooves 33*a* and second grooves 33*b* both extending in the direction X (see FIG. 3).

As described above, each first terminal 50 is inserted from the rear side into the corresponding first-terminal housing portion 361, and each second terminal 60 is inserted from the front side into the corresponding second-terminal housing portion 362.

At this time, each first terminal 50 is sandwiched between top wall part 32 and bottom wall part 33 at first groove 32*a* and first groove 33*a*. Meanwhile, each second terminal 60 is sandwiched between top wall part 32 and bottom wall part 33 at second groove 32*b* and second groove 33*b*.

Further as shown in FIG. 11A, each first-terminal housing portion 361 accommodating first terminal 50 has press-fitting part 361*a* into which first terminal 50 is pressed. More specifically, each first-terminal housing portion 361 is provided with insertion hole 361*c* into which after-mentioned fixed arm 54 (an arm in first terminal 50) shown in FIG. 12 is inserted. The lower end of insertion hole 361*c* is in the top face of bottom wall part 33, and the upper end of insertion hole 361*c* is in the bottom face of wall part 361*b*. Fixed arm 54 is pressed into insertion hole 361*c* from the rear side, so that first terminal 50 is fixedly held in housing 30.

Figure 13:
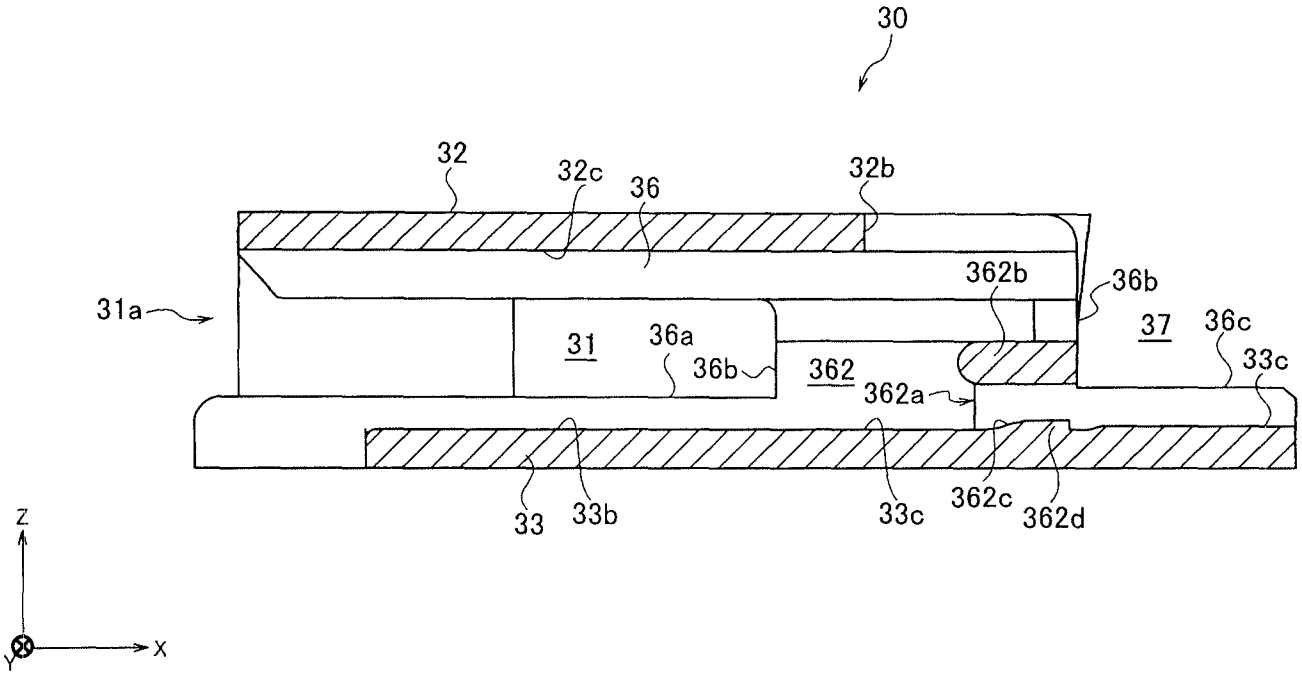
FIG. 13 is a sectional view of a second-terminal housing portion of the housing of the connector according to the exemplary embodiment of the present disclosure.

As shown in FIG. 13, each second-terminal housing portion 362 accommodating second terminal 60 has press-fitting part 362*a* into which second terminal 60 is pressed. More specifically, each second-terminal housing portion 362 is provided with insertion hole 362*c* into which after-mentioned terminal arm 65 shown in FIG. 14 is inserted. The lower end of insertion hole 362*c* is in the top face of bottom wall part 33, and the upper end of insertion hole 362*c* is in the bottom face of wall part 362*b*. Terminal arm 65 is pressed into insertion hole 362*c* from the front side, so that second terminal 60 is fixedly held in housing 30.

As shown in FIG. 12, first terminal 50 has bar-shaped fixed terminal part 51 extending, near bottom wall part 33, in the direction X. First terminal 50 further has bar-shaped movable terminal part 52 extending, near top wall part 32, in the direction X and opposing fixed terminal part 51 in the vertical direction Z. As described above, the direction Z is the thickness direction of housing 30 and cable 20. Fixed terminal part 51 and movable terminal part 52 are connected at their middle portions in the back-and-forth direction (longitudinal direction) X with connecting spring 53. Thus, first terminal 50 has a substantially H-shaped side face.

As shown in FIG. 12, fixed terminal part 51 includes fixed arm 54 extending along bottom wall part 33 forward in the direction X. Fixed arm 54 is a contact portion and is a first terminal side arm. Fixed terminal part 51 further includes terminal arm 55 extending along bottom wall part 33 backward in the direction X. In other words, terminal arm 55 extends toward the opposite side of fixed arm 54 in the direction X.

Fixed arm 54 has, at its tip, contact point 54*a* projecting upward, or in other words, toward inserted cable 20. Thus, first terminal 50 includes fixed arm 54, which is a first arm extending in the direction of inserting and removing cable 20 and having contact point 54*a*. Contact point 54*a* is brought into contact with the corresponding wide-width part 21*a* of conductor 21 shown in FIG. 4, located on the rear side (bottom face) of cable 20.

Fixed arm 54 has, near its root (near connecting spring 53), protruding portion 54*b* protruding upward, or in other words, toward wall part 361*b*. When fixed arm 54 is inserted into insertion hole 361*c* from the rear side, protruding portion 54*b* is engaged with wall part 361*b*, so that fixed arm 54 is pressed into press-fitting part 361*a*.

Terminal arm 55 has, at its tip, protruding portion 55*a* protruding downward. Protruding portion 55*a* functions as a surface mount solder joint when connector 10 is mounted on a circuit board (not shown). It is possible for protruding portion 55*a* to have a function as a stopper for controlling the maximum amount of insertion of first terminal 50 into housing 30 when first terminal 50 is inserted into the corresponding first-terminal housing portion 361.

As shown in FIG. 12, movable terminal part 52 includes movable arm 56 (contact portion) extending along top wall part 32 forward in the direction X. Movable terminal part 52 further includes spring 57 extending along top wall part 32 backward in the direction X. In other words, spring 57 extends toward the opposite side of movable arm 56 in the direction X.

Movable arm 56 has, at its tip, contact point 56*a* projecting downward, or in other words, toward inserted cable 20. Contact point 56*a* is brought into contact with the corresponding wide-width part 21*a* of conductor 21 shown in FIG. 5, located on the front side (top face) of cable 20.

When lever 70 is in the open position, the distance between contact points 54*a* and 56*a* is almost the same as the thickness of cable 20. If lever 70 is placed in the closed position without cable 20 being inserted, the distance between contact points 54*a* and 56*a* is made smaller than the thickness of cable 20. Therefore, when lever 70 is in the open position, cable 20 can be inserted into housing 30. Meanwhile, when lever 70 is in the closed position, contact points 54*a* and 56*a* together compress cable 20, so that first terminal 50 holds cable 20.

Spring 57 has, on its bottom face, substantially arc-shaped cam face 57*a* which comes into sliding contact with after-mentioned cam portion 74 of lever 70.

Connecting spring 53, which is elastically deformable, is inclined upward and forward so as to connect fixed terminal part 51 and movable terminal part 52. When spring 57 is deformed in the direction in which the rear end of spring 57 and the rear end of terminal arm 55 are apart from each other, connecting spring 53 is elastically deformed to reduce the spacing between movable arm 56 and fixed arm 54.

As shown in FIG. 14, second terminal 60 has bar-shaped fixed terminal part 61 extending, near bottom wall part 33, in the direction X. Second terminal 60 further has bar-shaped movable terminal part 62 extending, near top wall part 32, in the direction X and opposing fixed terminal part 61 in the vertical direction Z. The direction Z is the thickness direction of housing 30 and cable 20. Fixed terminal part 61 and movable terminal part 62 are connected at their middle portions in the back-and-forth direction (longitudinal direction) X with connecting spring 63. Thus, second terminal 60 has a substantially H-shaped side face.

As shown in FIG. 14, fixed terminal part 61 includes fixed arm 64 (contact portion) extending along bottom wall part 33 forward in the direction X. Fixed arm 64 is a contact portion and is a second terminal side arm. Fixed terminal part 61 further includes terminal arm 65 extending along bottom wall part 33 backward in the direction X.

Fixed arm 64 has, at its substantially center portion, contact point 64*a* projecting upward, or in other words, toward inserted cable 20. Contact point 64*a* is brought into contact with the corresponding wide-width part 21*b* of conductor 21 shown in FIG. 4, located on the rear side (bottom face) of cable 20.

Fixed arm 64 has, at its tip, protruding portion 64*b* protruding downward. Protruding portion 64*b* functions as a surface mount solder joint when connector 10 is mounted on a circuit board (not shown). It is possible for protruding portion 64*b* to have a function as a stopper for controlling the maximum amount of insertion of second terminal 60 into housing 30 when second terminal 60 is inserted into the corresponding second-terminal housing portion 362.

Terminal arm 65 has projection part 65*a* projecting downward. Bottom wall part 33 has engaging projection 362*d*, which projects upward and corresponds in position to insertion hole 362*c* shown in FIG. 13. When terminal arm 65 is pressed into insertion hole 362*c*, projection part 65*a* gets over engaging projection 362*d* and is hooked on the rear end of projection 362*d*. Thus, projection part 65*a* is hooked and engaged with the rear end of projection 362*d* so that second terminal 60 is fixedly held in housing 30.

As shown in FIG. 14, movable terminal part 62 includes movable arm 66 (contact portion) extending along top wall part 32 forward in the direction X. Movable terminal part 62 further includes spring 67 extending along top wall part 32 backward in the direction X. In other words, spring 67 extends toward the opposite side of movable arm 66 in the direction X.

Movable arm 66 has, at its tip, movable contact point (contact point) 66*a* projecting downward, or in other words, toward inserted cable 20. As shown in FIG. 5, contact point 66*a* is brought into contact with the corresponding wide-width part 21*b* of conductor 21 located on the front side (top face) of cable 20.

When lever 70 is in the open position, the distance between contact points 64*a* and 66*a* is almost the same as the thickness of cable 20. If lever 70 is placed in the closed position without cable 20 being inserted, the distance between contact points 64*a* and 66*a* is made smaller than the thickness of cable 20. Therefore, when lever 70 is in the open position, cable 20 can be inserted into housing 30. Meanwhile, when lever 70 is in the closed position, contact points 64*a* and 66*a* together compress cable 20, so that second terminal 60 holds cable 20.

Spring 67 has, on its bottom face, substantially arc-shaped cam face 67*a* which comes into sliding contact with after-mentioned cam portion 74 of lever 70.

Connecting spring 63, which is elastically deformable, is inclined upward and forward so as to connect fixed terminal part 61 and movable terminal part 62. When spring 67 is deformed in the direction in which the rear end of spring 67 and the rear end of terminal arm 65 are apart from each other, connecting spring 63 is elastically deformed to reduce the spacing between movable arm 66 and fixed arm 64.

As shown in FIGS. 12 and 14, movable arm 56 of first terminal 50 has an arm length (effective length of engagement) D6, and movable arm 66 of second terminal 60 has an arm length (effective length of engagement) D7. The arm length D6 is larger than the arm length D7.

Movable arm 56 of first terminal 50 having contact point 56*a* corresponds to a contact portion with a longer effective length of engagement. Movable arm 66 of second terminal 60 having contact point 66*a* corresponds to a contact portion with a shorter effective length of engagement.

The terminals (contacts) are not limited to two kinds, and can be three kinds or more, or one kind.

In the present exemplary embodiment, the two of first terminals 50 that are located at both ends of housing 30 in the width direction Y are used as holding terminals 50A so as to prevent cable 20 inserted in housing 30 from coming off.

As described above, according to the present exemplary embodiment, the two of first terminals 50 that are located at both ends are used as holding terminals 50A. Therefore, holding terminals 50A are identical in shape to first terminals 50. It is unnecessary, however, to use first terminals 50 as holding terminals 50A, and hence, to make holding terminals 50A completely identical in shape to first terminals 50. For example, holding terminals 50A may differ in shape only partially (for example, holding parts) from first terminals 50.

As shown in FIG. 16, holding terminal 50A has bar-shaped fixed terminal part 51A extending, near bottom wall part 33, in the direction X. Holding terminal 50A further has bar-shaped movable terminal part 52A extending, near top wall part 32, in the direction X and opposing fixed terminal part 51A in the vertical direction Z. As described above, the direction Z is the thickness direction of housing 30 and cable 20. Fixed terminal part 51A and movable terminal part 52A are connected at their middle portions in the back-and-forth direction (longitudinal direction) X with connecting spring 53A. Thus, holding terminal 50A has a substantially H-shaped side face.

Two holding terminals 50A are inserted from the rear side into holding-terminal housing portions (hereinafter, second housing portions) 363, which are formed at both ends of housing 30 in the width direction Y.

Each second housing portion 363 is separated from inner adjacent second-terminal housing portion 362 in the width direction Y by vertical wall part 36 shown in FIG. 10 extending in the direction X. Meanwhile, the outer side of each second housing portion 363 in the width direction Y is composed of side wall part 34. In other words, each second housing portion 363, which penetrates in the direction X, is composed of top wall part 32, bottom wall part 33, side wall part 34, and vertical wall part 36. Holding terminal 50A is inserted from the rear side into the corresponding second housing portion 363.

Figure 15A:
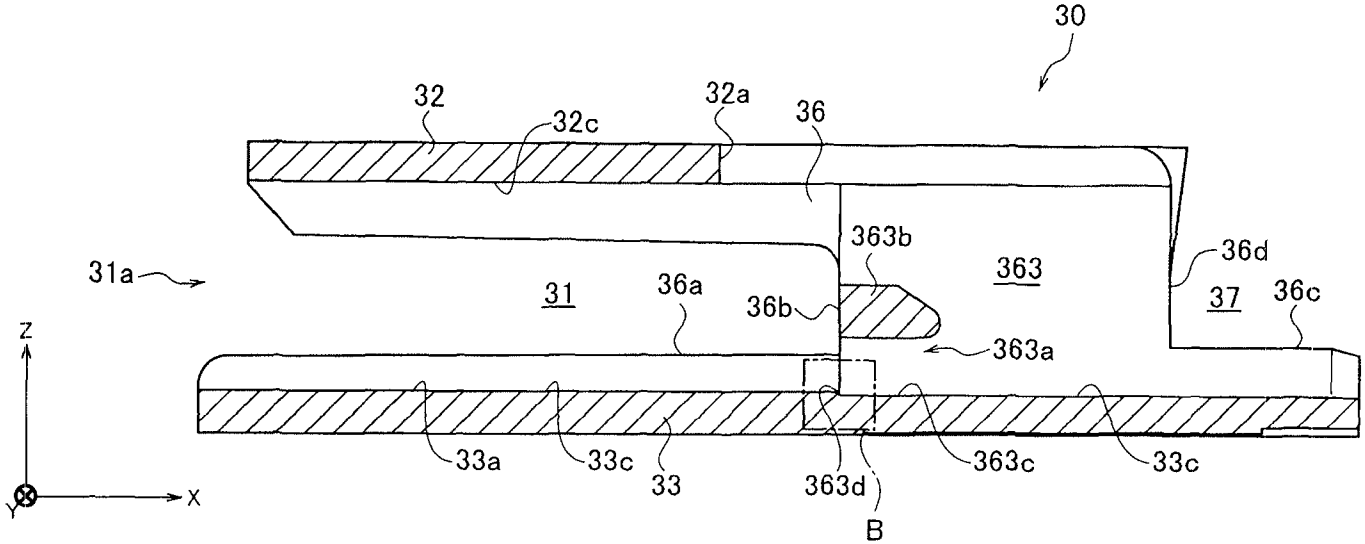
FIG. 15A is a sectional view of a second housing portion (holding-terminal housing portion) of the housing of the connector according to the exemplary embodiment of the present disclosure.

As shown in FIGS. 15A and 16, each vertical wall part 36 is, in its front part, provided with substantially U-shaped notch 36*a*, which is open forward. Notches 36*a* allow planar cable 20 to be inserted into cable reception part 31 without being hindered by vertical wall parts 36. Back wall surface 36*b* is provided at the back of notch 36*a* (at the back in the direction X) and controls the movement of cable 20 toward the rear side (toward the insertion direction).

Each vertical wall part 36 has, at its rear, a substantially L-shaped opening part backward and upward. In the L-shaped opening parts of vertical wall parts 36, lower-side front surfaces 36*c* and upper-side back surfaces 36*d* together form lever attaching part 37. Thus, the rear of each vertical wall part 36 is a part of the above-described extended part 331. In other words, lower-side front surface 36*c* of each vertical wall part 36 is a part of top surface 331*a* of extended part 331.

Each holding terminal 50A is inserted from the rear side into corresponding second housing portion 363 and sandwiched between first groove 32*a* of top wall part 32 and first groove 33*a* of bottom wall part 33.

Second housing portion 363 accommodating holding terminal 50A has press-fitting part 363*a* into which holding terminal 50A is pressed. More specifically, second housing portion 363 is provided with insertion hole 363*c* into which after-mentioned fixed arm 54 shown in FIG. 12 is inserted. The lower end of insertion hole 363*c* is in the top face of bottom wall part 33, and the upper end of insertion hole 363*c* is in the bottom face of wall part 363*b*. Fixed arm 54A (a holding terminal side arm) is pressed into insertion hole 363*c* from the rear side, so that holding terminal 50A is fixedly held in housing 30.

As shown in FIG. 16, fixed terminal part 51A includes fixed arm 54A extending along bottom wall part 33 forward in the direction X. Fixed terminal part 51A further includes terminal arm 55A extending along bottom wall part 33 backward in the direction X. In other words, terminal arm 55A extends toward the opposite side of fixed arm 54A in the direction X.

Fixed arm 54A has, at its tip, fixed holding part (hereinafter, holding part) 54*a*A projecting upward, or in other words, toward inserted cable 20. Holding part 54*a*A is locked into notch-shaped holding hole 22 from below. Two holding parts 54*a*A, which correspond to contact points 54*a* of the two first terminals 50 functioning as holding terminals 50A, function as holding parts for holding cable 20. Thus, holding terminal 50A includes fixed arm 54A, which is a second arm having holding part 54*a*A and extending in the direction of inserting and removing cable 20.

Fixed arm 54A has, near its root (near connecting spring 53A), protruding portion 54*b*A protruding upward, or in other words, toward wall part 363*b*. When fixed arm 54A is inserted into insertion hole 363*c* from the rear side, protruding portion 54*b*A is engaged with wall part 363*b*, so that fixed arm 54A is pressed into press-fitting part 363*a*.

Terminal arm 55A has, at its tip, protruding portion 55*a*A protruding downward. Protruding portion 55*a*A functions as a surface mount solder joint when connector 10 is mounted on a circuit board (not shown). It is possible for protruding portion 55*a*A to have a function as a stopper for controlling the maximum amount of insertion of holding terminal 50A into housing 30 when holding terminal 50A is inserted into the corresponding second housing portion 363.

As shown in FIG. 16, movable terminal part 52A includes movable arm 56A extending along top wall part 32 forward in the direction X. Movable terminal part 52A further includes spring 57A extending along top wall part 32 backward in the direction X. In other words, spring 57A extends toward the opposite side of movable arm 56A in the direction X.

Movable arm 56A has, at its tip, movable holding part (hereinafter, holding part) 56*a*A projecting downward, or in other words, toward inserted cable 20. As shown in FIG. 5, holding part 56*a*A is locked into notch-shaped holding hole 22 from above. Two holding parts 56*a*A, which correspond to contact points 56*a* of two first terminals 50 functioning as holding terminals 50A, function as holding parts for holding cable 20.

Spring 57A has, on its bottom face, substantially arc-shaped cam face 57*a*A which comes into sliding contact with after-mentioned cam portion 74 of lever 70.

Connecting spring 53A, which is elastically deformable, is inclined upward and forward so as to connect fixed terminal part 51A and movable terminal part 52A. When spring 57A is deformed in the direction in which the rear end of spring 57A and the rear end of terminal arm 55A are apart from each other, connecting spring 53A is elastically deformed to reduce the spacing between movable arm 56A and fixed arm 54A.

Using first terminals 50 as holding terminals 50A eliminates the need to provide other terminals for holding cable 20, thereby contributing to cost reduction.

Furthermore, according to the present exemplary embodiment, when lever 70 is in the open position, the distance between contact points 54*a* and 56*a* is almost the same as the thickness of cable 20. This configuration improves the insertability of cable 20 into housing 30.

However, the mere use of first terminals 50 as holding terminals 50A would not allow holding terminals 50A to temporarily hold cable 20 when cable 20 is inserted into housing 30.

If holding terminals 50A were configured to temporarily hold cable 20, the insertability of cable 20 into housing 30 would decrease.

In contrast, according to the present exemplary embodiment, cable 20 can be easily inserted into housing 30, and at the same time, can be temporarily held by holding terminals 50A.

More specifically, when housing 30 is oriented horizontally in the direction X, holding parts 54*a*A of holding terminals 50A accommodated in second housing portions 363 differ in position in height from fixed contact points 54*a* (contact points) of first terminals 50 accommodated in first-terminal housing portions 361. The direction X is the direction of inserting and removing cable 20, and the position in height is the position in the vertical direction Z.

As shown in FIG. 17, in the present exemplary embodiment, when holding parts 54*a*A and contact points 54*a* are positioned below cable 20 to be inserted, holding parts 54*a*A are positioned above contact points 54*a*.

In other words, housing 30 is oriented so that the direction X is horizontal and that cable 20 is inserted above holding parts 54*a*A and contact points 54*a*. In this case, holding parts 54*a*A are positioned above contact points 54*a*.

Furthermore, in the present exemplary embodiment, either first-terminal housing portion 361 as the first housing portion or second housing portion 363, or both include a stepped portion. When formed in first-terminal housing portion 361, the stepped portion displaces fixed arm 54, which is the first arm. When formed in second housing portion 363, the stepped portion displaces fixed arm 54A, which is the second arm. Thus, holding part 54*a*A can differ in position in height from fixed contact point 54*a*.

Figure 15B:
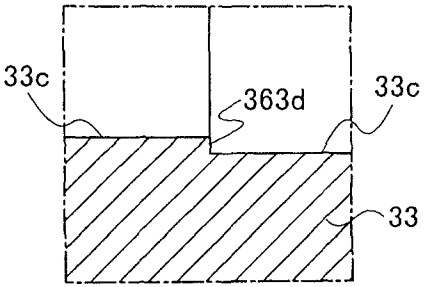
FIG. 15B is an enlarged sectional view of Part B shown in FIG. 15A.

More specifically, as shown in FIG. 15B, second housing portion 363 includes stepped portion 363*d* in its lower part (in bottom wall part 33) so that the front portion of the lower part can be located above the rear portion of the lower part. Stepped portion 363*d* allows the bottom face of second housing portion 363 to be closer to cable 20 on the removing side than on the insertion side in the direction of inserting and removing cable 20 when housing 30 is oriented horizontally in the direction X and cable 20 is inserted in housing 30. The bottom face of second housing portion 363 is top surface 33*c* of bottom wall part 33. The removing side and the insertion side in the direction of inserting and removing cable 20 are respectively the front and the rear in the direction X. Alternatively, the top face of second housing portion 363 may be closer to cable 20 on the removing side than on the insertion side in the direction of inserting and removing cable 20. The top face of second housing portion 363 is bottom surface 32*c* of top wall part 32. Further alternatively, both the top and bottom faces may satisfy the above conditions.

When holding terminal 50A is inserted into the corresponding second housing portion 363 from the rear side, fixed arm 54A is displaced to move its tip (holding part 54*a*A) upward.

Figure 11B:
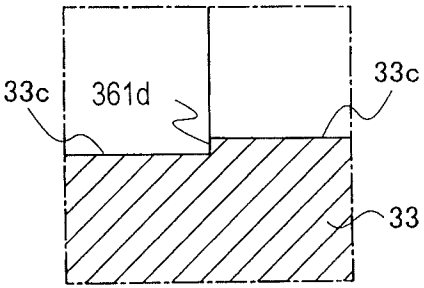
FIG. 11B is an enlarged sectional view of Part A shown in FIG. 11A.

Furthermore, as shown in FIG. 11B, first-terminal housing portion 361 includes stepped portion 361*d* in its lower part (in bottom wall part 33) so that the front portion of the lower part can be located below the rear portion of the lower part. Stepped portion 361*d* allows the bottom face of first-terminal housing portion 361 to be closer to cable 20 on the insertion side than on the removing side in the direction of inserting and removing cable 20 when housing 30 is oriented horizontally in the direction X and cable 20 is inserted in housing 30. The bottom face of first-terminal housing portion 361 is top surface 33*c* of bottom wall part 33. Alternatively, the top face of first-terminal housing portion 361 may be closer to cable 20 on the insertion side than on the removing side in the direction of inserting and removing cable 20. The top face of first-terminal housing portion 361 is bottom surface 32*c* of top wall part 32. Further alternatively, both the top and bottom faces may satisfy the above conditions.

When first terminal 50 is inserted into first-terminal housing portion 361 from the rear side, fixed arm 54 is displaced to move its tip (contact point 54*a*) downward.

Thus, holding parts 54*a*A can be located higher than fixed contact points 54*a* by making the front side of stepped portions 363*d* higher than the rear side thereof, and the front side of stepped portions 361*d* lower than the rear side thereof.

When holding terminals 50A are accommodated in second housing portions 363, holding parts 54*a*A and 56*a*A are away from each other by a distance D8. When first terminals 50 are accommodated in first-terminal housing portions 361, contact points 54*a* and 56*a* are away from each other by a distance D9. The distance D8 is shorter than the distance D9.

With this configuration, cable 20 can be easily inserted into housing 30 without being hindered by contact points 54*a* and 56*a* of first terminals 50 when lever 70 is in the open position.

Furthermore, when lever 70 is in the open position and cable 20 is inserted into housing 30, cable 20 can be temporarily held by holding parts 54*a*A, and can be prevented from coming off connector 10. When lever 70 is placed in the closed position, cable 20 is held by holding parts 54*a*A and 56*a*A.

Stepped portions 363*d* and 361*d* can be formed simultaneously with the resin-molding of housing 30. For example, a mold consisting of two halves (not shown) divided in the direction X is prepared, and the two halves are combined in such a manner that stepped portions can be formed at the boundaries of the two halves (at the position of back wall surface 36*b*). Thus, stepped portions 363*d* and 361*d* can be formed simultaneously with the resin-molding of housing 30.

As shown in FIGS. 4 and 5, in cable 20, outermost conductors 21 that correspond to holding terminals 50A on both sides are not electrically connected to the conductors (not shown) contained in body 20*a* due to the presence of holding holes 22. Holding terminals 50A on both sides are not intended to be used as contacts for signal transmission. It is therefore not necessary to provide conductors 21 in cable 20 at the positions corresponding to holding terminals 50A.

As shown in FIGS. 3 and 7, lever 70 is provided with through-holes 73, which correspond to springs 57, 67, and 57A in first terminals 50, second terminals 60, and holding terminals 50A, respectively. Through-holes 73 in lever 70 are adjacent to cam portions 74, which turn with lever 70 and come into sliding contact with cam faces 57*a*, 67*a*, and 57*a*A formed on springs 57, 67, and 57A, respectively (see FIGS. 12, 14, and 16).

Each cam portion 74 includes substantially cylindrical circular portion 74*a*, and substantially rectangular parallelepiped square part 74*b* adjoining to circular portion 74*a*. Each cam portion 74 has a keyhole-like cross section when viewed in the direction X.

When lever 70 is in the open position, cam portions 74 extend laterally (in the direction X). The length of each cam portion 74 in the vertical direction Z is smaller than each of the following spacings: the spacing between spring 57 and terminal arm 55 of first terminal 50, the spacing between spring 67 and terminal arm 65 of second terminal 60, and the spacing between spring 57A and terminal arm 55A of holding terminal 50A. In other words, when lever 70 is in the open position, cam portions 74 and springs 57, 67, and 57A are out of contact with each other.

Meanwhile, when lever 70 is turned toward the closed position, while cam portions 74 are turning and rising, the length of each cam portion 74 in the vertical direction Z becomes larger than each of the following spacings: the spacing between spring 57 and terminal arm 55, the spacing between spring 67 and terminal arm 65, and the spacing between spring 57A and terminal arm 55A.

Springs 57, 67, and 57A are elastically deformed to increase the following spacings, respectively: the spacing between the tip of spring 57 and the tip of terminal arm 55, the spacing between the tip of spring 67 and the tip of terminal arm 65, and the spacing between the tip of spring 57A and the tip of terminal arm 55A.

The following is a description of how connector 10 is operated when lever 70 is being closed.

First, cable 20 is inserted into housing 30 when lever 70 is in the open position. At this moment, holding part 54*a*A of each fixed arm 54A is inserted from below into corresponding holding hole 22 of cable 20, so that cable 20 is locked into holding parts 54*a*A. In short, cable 20 is temporarily held by holding terminals 50A.

When lever 70 is turned clockwise shown in FIG. 1, cam portion 74 comes into sliding contact with cam faces 57*a* of springs 57, cam faces 67*a* of springs 67, and cam faces 57*a*A of springs 57A. When lever 70 is turned toward the closed position further, cam portions 74 elastically deform springs 57, 67, and 57A to increase the following spacings, respectively: the spacing between the tips of springs 57 and the tips of terminal arms 55, the spacing between the tips of springs 67 and the tips of terminal arms 65, and the spacing between the tips of springs 57A and the tips of terminal arms 55A.

The elastic deformation of each spring 57 results in the elastic deformation of corresponding connecting spring 53. Thus, the deformation of spring 57 and connecting spring 53 allows each first terminal 50 to be elastically deformed to reduce the spacing between movable arm 56 of movable terminal part 52 and fixed arm 54 of fixed terminal part 51. In other words, each contact point 56*a* moves toward corresponding contact point 54*a* to reduce the distance between them. As a result, cable 20, which is compressed between contact points 56*a* and 54*a*, is conductively connected to each first terminal 50.

Each second terminal 60 operates in the same manner as first terminal 50 as follows. The elastic deformation of spring 67 results in the elastic deformation of connecting spring 63. Thus, the deformation of spring 67 and connecting spring 63 allows second terminal 60 to be elastically deformed to reduce the spacing between movable arm 66 of movable terminal part 62 and fixed arm 64 of fixed terminal part 61. In other words, contact point 66*a* move toward contact point 54*a* to reduce the distance between them. As a result, cable 20, which is compressed between contact points 66*a* and 54*a*, is conductively connected to each second terminal 60.

At this moment, holding parts 56*a*A and 54*a*A of each holding terminal 50A on either side in the width direction Y is elastically deformed to reduce the spacing between them when spring 57A and connecting spring 53A are deformed. As a result, holding parts 56*a*A and 54*a*A are more deeply inserted into holding holes 22 from the front and rear sides of cable 20. Thus, holding parts 56*a*A and 54*a*A are locked into holding hole 22 to prevent cable 20 inserted in housing 30 from coming off.

Meanwhile, when lever 70 is turned clockwise shown in FIG. 1, each pivot shaft 71 turns about the turn center C shown in FIG. 9B.

More specifically, at the beginning of the turn of lever 70, each pivot shaft 71 turns counterclockwise in such a manner that front-upper vertex 71*e* shown in FIG. 9A moves backward and upward.

During the turn of lever 70 from the open position to the closed position, back-lower vertex 71*g*, which is one end of wide-width part 71*i*, comes into contact with first inner surface 38*e*, whereas front-upper vertex 71*e* comes into contact with bottom surface 38*d* of upper wall part 38*b*.

When lever 70 is further turned toward the closed position, front-upper vertex 71*e*, which is the other end of wide-width part 71*i* of each pivot shaft 71, comes into sliding contact with bottom surface 38*d* while back-lower vertex 71*g* is in sliding contact with first inner surface 38*e*. At this moment, front-upper vertex 71*e* elastically deforms upper wall part 38*b* upward, and at the same time, slides with bottom surface 38*d* of upper wall part 38*b*.

Upper wall part 38*b* is elastically deformed upward until the diagonal connecting back-lower vertice 71*g* and front-upper vertice 71*e* becomes vertical, or in other words, until front-upper vertex 71*e* reaches the uppermost point.

When lever 70 is further turned toward the closed position, pivot shaft 71 turns so that front-upper vertex 71*e* moves backward and downward and, upper wall part 38*b* moves downward to return to the original condition. When lever 70 is turned as far as the closed position, front face 71*c* is substantially horizontal and above the other faces.

As described above, when lever 70 is turned from the open position to the closed position, the elastic restoring force of upper wall part 38*b* as the second wall part acts in the direction of hindering the turn of lever 70 partway. When the turn exceeds a predetermined amount, the elastic restoring force of upper wall part 38*b* acts in the direction of accelerating the turn of lever 70. In short, the elastic restoring force of upper wall part 38*b* pushes pivot shaft 71, so that the direction of the moment acting on lever 70 changes from the opening direction to the closing direction while lever 70 is being turned from the open position to the closed position.

As described above, the direction of the moment acting on lever 70 is changed from the opening direction to the closing direction during the turn of lever 70, thereby providing the user who operates lever 70 with a click feel. The same click feel can be provided when the user turns lever 70 from the closed position to the open position.

Thus, lever 70 is turned from the open position to the closed position when cable 20 is inserted in housing 30, thereby achieving connector assembly 100 in which cable 20 is locked into housing 30 of connector 10 as shown in FIG. 2.

As described above, connector 10 includes housing 30 into which cable 20 is to be inserted, terminals 40 accommodated in housing 30 and to be conductively connected to cable 20, and lever 70. Lever 70, which includes pivot shafts 71 as turning shafts, is attached to housing 30 in such a manner as to turn around pivot shafts 71 between the open position and the closed position (the first position and the second position). When lever 70 is in the open position, cable 20 can be inserted into housing 30, and when lever 70 is in the closed position, cable 20 is held in housing 30.

Housing 30 includes bearings 38 as supporting parts, to which lever 70 is attached. Lever 70 includes pivot shafts 71 as attachment parts, which are located at both ends of lever 70 in the width direction Y and attached to bearings 38, respectively.

Either pivot shafts 71 or bearings 38, or both of them have defective-closing prevention structure 80 for preventing lever 70 from turning from the open position to the closed position when cable 20 is not inserted in housing 30.

This configuration prevents lever 70 from turning from the open position to the closed position in a case that someone touches lever 70 without cable 20 being inserted in housing 30, or that circuit boards are stacked. As a result, terminals 40 are prevented from being plastically deformed due to the defective closing of lever 70, so that the connection reliability of connector 10 can be maintained.

By providing defective-closing prevention structures 80 at both ends of lever 70 in the width direction Y, the load applied at the time of opening or closing lever 70 can be constant regardless of the number of terminals 40.

As described above, pivot shafts 71 function as the attachment parts of lever 70, and bearings 38 in housing 30 function as the supporting parts to support pivot shafts 71.

Pivot shafts 71 are configured to turn with lever 70 when lever 70 is turned from the open position to the closed position.

Each pivot shaft 71 has wide-width part 71*i* and narrow-width part 71*j* narrower than wide-width part 71*i* in the direction orthogonal to the width direction Y. Each bearing 38 has inner surfaces (first inner surface 38*e* and the second inner surface (bottom surface 38*d*)) opposing outer peripheral face 71*k* of pivot shaft 71.

Each bearing 38 is so configured that the inner surfaces of bearing 38 come into sliding contact with both ends of wide-width part 71*i* of outer peripheral face 71*k* of pivot shaft 71 during the turn of lever 70 from the open position to the closed position. This configuration achieves defective-closing prevention structure 80.

In this configuration, lever 70 can be prevented from turning from the open position to the closed position only by bringing wide-width part 71*i* into contact with the inner surfaces of bearing 38 during the turn of lever 70. As a result, defective-closing prevention structure 80 can be achieved by a simple structure.

Each pivot shaft 71 may have a most distant point (front-upper vertex 71*e*) from the turn center C of pivot shaft 71 and a least distant point (back face 71*d*) from the turn center C. In this case, defective-closing prevention structure 80 can be formed as follows.

First, the region, of the inner surfaces of each bearing 38, that opposes the most distant point (front-upper vertex 71*e*) of pivot shaft 71 when lever 70 is turned from the open position to the closed position is referred to as the counter region (bottom surface 38*d*). Next, the region, of the counter region, that is nearest from the turn center C of pivot shaft 71 is referred to as the nearest region S.

Each bearing 38 is so configured that the region opposing the most distant point (front-upper vertex 71*e*) during the turn of lever 70 from the open position to the closed position can be the nearest region S, and that the distance from the turn center C of pivot shaft 71 to the nearest region S is shorter than the distance from the turn center C of pivot shaft 71 to the most distant point (front-upper vertex 71*e*).

This is how defective-closing prevention structure 80 is achieved.

In this configuration, lever 70 can be prevented from turning from the open position to the closed position only by bringing the most distant point into contact with the inner surfaces of bearing 38 during the turn of lever 70. As a result, defective-closing prevention structure 80 can be achieved by a simple structure.

In the present exemplary embodiment, each pivot shaft 71 has a cross section of a substantial square in the direction orthogonal to the width direction Y.

This allows defective-closing prevention structure 80 to have a simple structure, and lever 70 to be manufactured easily.

In the case that each pivot shaft 71 has a cross section of a substantial square, the following can be achieved. When lever 70 is turned about 90° from the open position to the closed position, one of the four flat faces of pivot shaft 71 can be brought into surface contact with top surface 331*a* (first inner surface 38*e*) at the end of extended part 331 in the width direction Y regardless of whether lever 70 is in the open or closed position. The flat face is bottom face 71*b* shown in FIG. 9A when lever 70 is in the open position, and is back face 71*d* shown in FIG. 9A when lever 70 is in the closed position. Hence, lever 70 can be stably held whether it is in the open or closed position. More specifically, when in the open position, lever 70 is prevented from turning to the closed position by the surface contact between bottom face 71*b* and first inner surface 38*e*. When in the closed position, lever 70 is prevented from turning to the open position by the surface contact between back face 71*d* and first inner surface 38*e*.

In the present exemplary embodiment, pivot shafts 71 and bearings 38 are made of resin at least at their areas of contacting each other.

When both pivot shafts 71 and bearings 38 are made of resin at their areas of contact, the resin is less likely to be worn away than in the case that it comes into contact with metal. Therefore, the load applied at the time of opening or closing lever 70 can be maintained in a better condition, or in other words, can be prevented from becoming too high or too low.

Each bearing 38 includes extended part 331 and upper wall part 38*b*. The end of extended part 331 in the width direction Y is the first wall part having first inner surface 38*e* as a part of the inner surface opposing outer peripheral face 71*k* of the corresponding pivot shaft 71. Meanwhile, upper wall part 38*b* is the second wall part having bottom surface 38*d* as the second inner surface, which is a part of the inner surface and is away from and opposite to first inner surface 38*e* of extended part 331.

Each upper wall part 38*b* is cantilever-supported at the corresponding extended part 331.

With this configuration, upper wall part 38*b* can be displaced more easily relative to extended part 331. As a result, the load applied at the time of opening or closing lever 70 can be absorbed by the displacement, and hence, can be maintained in a better condition.

At least one of upper wall part 38*b* and extended part 331 is elastically deformable.

As a result, the load applied at the time of opening or closing lever 70 can be absorbed by the elastic deformation, and hence, can be maintained in a better condition.

Connector 10 includes first terminals 50 accommodated in first-terminal housing portions 361 as the first housing portions, and holding terminals 50A accommodated in second housing portions 363. Each first terminal 50 is identical in shape to each holding terminal 50A.

First terminal 50 includes fixed contact point 54*a* configured to come into contact with cable 20. Holding terminal 50A includes holding part 54*a*A corresponding in position to fixed contact point 54*a* of first terminal 50 and is configured to hold cable 20.

When housing 30 is oriented horizontally in the direction X, holding part 54*a*A of each holding terminal 50A accommodated in second housing portion 363 differs in position in height from fixed contact point 54*a* of each first terminal 50 accommodated in first-terminal housing portion 361.

With this configuration, terminals 40 identical in shape can be used as both first terminals 50 and holding terminals 50A. In addition, those of terminals 40 that are used as holding terminals 50A can have the function of temporarily holding cable 20.

When housing 30 is oriented so that the direction X is horizontal and that cable 20 is inserted above holding parts

54*a*A and fixed contact points 54*a*, holding parts 54*a*A are positioned above fixed contact points 54*a*.

With this configuration, when lever 70 is in the open position, even if the distance between contact points 54*a* and 56*a* is made almost the same as the thickness of cable 20, each holding part 54*a*A projects above the rear side (bottom face) of cable 20. Therefore, when cable 20 is inserted into housing 30, holding part 54*a*A is locked into holding hole 22 of cable 20 from below.

Therefore, cable 20 can be easily inserted into housing 30, and holding terminals 50A can temporarily hold cable 20.

Each first terminal 50 includes fixed arm 54 extending in the direction X and having fixed contact point 54*a*. Meanwhile, each holding terminal 50A includes fixed arm 54A extending in the direction X and having holding part 54*a*A. Fixed arm 54 is the first arm, and fixed arm 54A is the second arm.

Stepped portions (361*d* and 363*d*) are formed in either second housing portions 363 or first-terminal housing portions 361, or both of them. When formed in each first-terminal housing portion 361, stepped portion 361*d* displaces fixed arm 54. When formed in each second housing portion 363, stepped portion 363*d* displaces fixed arm 54A.

By forming either stepped portions 361*d* or 363*d* or both of them, each holding part 54*a*A can differ in position in height from fixed contact point 54*a* only by accommodating terminals 40 identical in shape into second housing portions 363 and first-terminal housing portions 361.

As a result, those of terminals 40 that are used as holding terminals 50A can have the function of temporarily holding cable 20 in a simple structure.

In the case that stepped portions are formed in both second housing portion 363 and first-terminal housing portion 361 in opposite directions, the displacement of terminals 40 can be reduced when the height difference is set to a predetermined amount. This can reduce the plastic deformation of terminals 40, and can reduce a decrease in the connection reliability of connector 10.

Stepped portions 361*d* and 363*d* may be formed simultaneously with the resin-molding of housing 30 made of resin.

This simplifies the formation of the stepped portions (361*d* and 363*d*), which are formed simultaneously with the resin-molding of housing 30.

Alternatively, at least one of the top face (bottom surface 32*c* of top wall part 32) and the bottom face (top surface 33*c* of bottom wall part 33) of each second housing portion 363 may be closer to cable 20 at the front side than the rear side in the direction X when housing 30 is oriented horizontally in the direction X and cable 20 is inserted in housing 30.

With this configuration, holding parts 54*a*A can differ in position in height from fixed contact points 54*a* only by accommodating terminals 40 identical in shape into second housing portions 363. In short, holding parts 54*a*A can be located closer to cable 20 than fixed contact points 54*a* are.

As a result, those of terminals 40 that are used as holding terminals 50A can have the function of temporarily holding cable 20 in a simple structure.

Alternatively, at least one of the top face (bottom surface 32*c* of top wall part 32) and the bottom face (top surface 33*c* of bottom wall part 33) of each first-terminal housing portion 361 may be closer to cable 20 at the rear side than the front side in the direction X when housing 30 is oriented horizontally in the direction X and cable 20 is inserted in housing 30.

With this configuration, holding parts 54*a*A can differ in position in height from fixed contact points 54*a* only by accommodating terminals 40 identical in shape into first-terminal housing portions 361. In short, holding parts 54*a*A can be located closer to cable 20 than fixed contact points 54*a* are.

As a result, those of terminals 40 that are used as holding terminals 50A can have the function of temporarily holding cable 20 in a simple structure.

Thus, connector 10 of the present exemplary embodiment can reduce the cost thereof and be unlikely to cause cable 20 to come off it.

The preferred exemplary embodiment of the present disclosure has described so far, but the present disclosure is not limited to the exemplary embodiment and can be variously modified.

Figure 19:
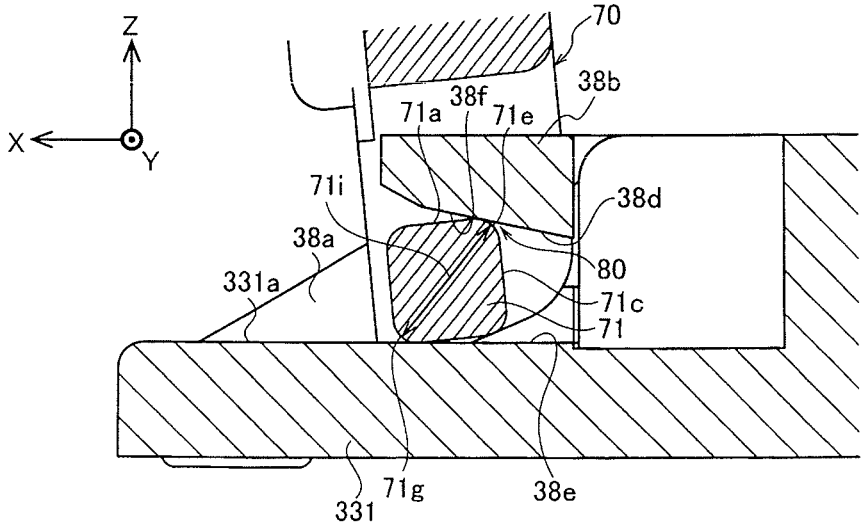
FIG. 19 is a sectional view showing a state that a pivot shaft of the lever of a connector according to a first modified example of the exemplary embodiment of the present disclosure is supported by a bearing.

For example, as shown in FIG. 19, at least one of extended part 331 (or the first wall part) and upper wall part 38*b* may include inclined surface 38*f*. FIG. 19 is a sectional view showing a state that a pivot shaft of the lever of a connector according to a first modified example of the exemplary embodiment of the present disclosure is supported by a bearing.

FIG. 19 shows an example in which inclined surface 38*f* inclined forward and downward is formed on bottom surface 38*d* of upper wall part 38*b* as the second wall part. Providing inclined surface 38*f* reduces the distance between pivot shaft 71 and bottom surface 38*d* at the front of pivot shaft 71 moving upward when lever 70 is turned from the open position to the closed position.

As a result, at the beginning of the turn of lever 70 from the open position to the closed position, or in other words, when lever 70 has not turned very much, front-upper vertex 71*e* of pivot shaft 71 comes into contact with inclined surface 38*f*. In other words, front-upper vertex 71*e* comes into contact with inclined surface 38*f* when lever 70 is very nearly in the open position.

With this configuration, during the turn of lever 70 from the open position to the closed position, the outer peripheral face at both ends of wide-width part 71*i* in pivot shaft 71 comes into sliding contact with the inner surface of bearing 38. More specifically, back-lower vertex 71*g*, which is one end of wide-width part 71*i* comes into sliding contact with first inner surface 38*e*, whereas front-upper vertex 71*e*, which is the other end comes into sliding contact with inclined surface 38*f* of bottom surface 38*d*, which is the second inner surface.

Even when pivot shafts 71 and bearings 38 have the above-described structure, defective-closing prevention structure 80 for preventing lever 70 from turning from the open position to the closed position when cable 20 is not inserted in housing 30 can be achieved.

This configuration provides the same action and effect as those of the exemplary embodiment described earlier.

In the structure shown in FIG. 19, front-upper vertex 71*e* of pivot shaft 71 comes into contact with inclined surface 38*f* when lever 70 is almost in the open position. This contact immediately prevents lever 70 from turning to the closed position, thereby preventing the defective closing of lever 70 more reliably.

Figure 20:
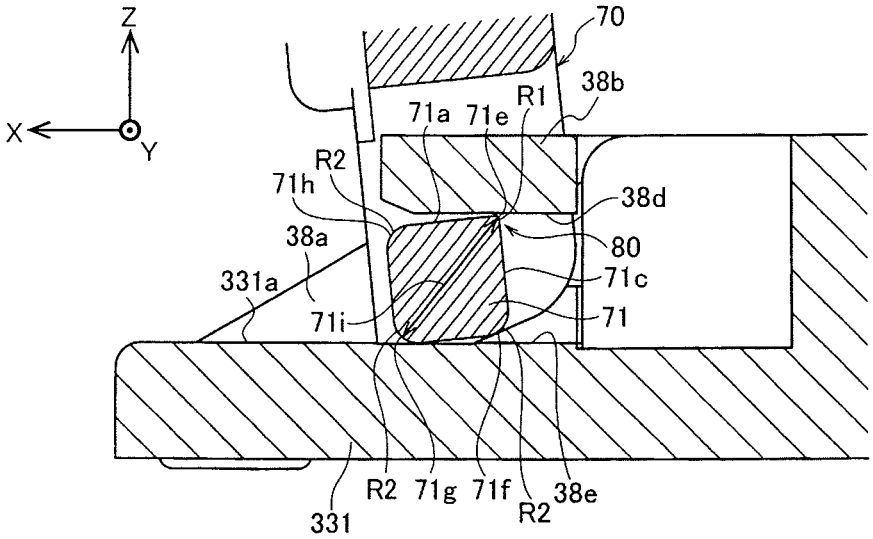
FIG. 20 is a sectional view showing a state that a pivot shaft of the lever of a connector according to a second modified example of the exemplary embodiment of the present disclosure is supported by a bearing.

It is alternatively possible to achieve defective-closing prevention structure 80 by sharpening (reducing the radius of curvature of) the vertices of pivot shaft 71 as shown in FIG. 20. FIG. 20 is a sectional view showing a state that a pivot shaft of the lever of a connector according to a second modified example of the exemplary embodiment of the present disclosure is supported by a bearing.

More specifically, in FIG. 20, similar to FIG. 9A, pivot shaft 71 has a cross section of a substantial square in the x-z plane. In short, the cross section of pivot shaft 71 in the x-z plane has four vertices (at least three vertices).

Of the four vertices (front-upper vertex 71*e*, front-lower vertex 71*f*, back-lower vertex 71*g*, and back-upper vertex 71*h*), two vertices (front-upper and back-lower vertices 71*e* and 71*g*) come into contact with first inner surface 38*e* of extended part 331 included in the first wall part and bottom surface 38*d* (the second inner surface) of upper wall part 38*b* as the second wall part during the turn of lever 70 from the open position to the closed position. Meanwhile, the other two vertices do not come into contact with first inner surface 38*e* or bottom surface 38*d* of upper wall part 38*b*.

During the turn of lever 70 from the open position to the closed position, at least one of the two vertices (front-upper and back-lower vertices 71*e* and 71*g*) coming into contact with first inner surface 38*e* and bottom surface 38*d* has a radius of curvature R1, and the other two vertices (front-lower and back-upper vertices 71*f* and 71*h*) not coming into contact with first inner surface 38*e* or bottom surface (second inner surface) 38*d* has a radius of curvature R2. The radius of curvature R1 is smaller than the radius of curvature R2.

In the example of FIG. 20, the radius of curvature R1 of front-upper vertex 71*e* is smaller than the radius of curvature R2 of front-lower and back-upper vertices 71*f* and 71*h*.

In the example shown in FIG. 20, the radius of curvature of back-lower vertex 71*g* coming into contact with first inner surface 38*e* is substantially equal to the radius of curvature R2 of front-lower and back-upper vertices 71*f* and 71*h*.

Alternatively, the radius of curvature of back-lower vertex 71*g* can be substantially equal to the radius of curvature R1 of front-upper vertex 71*e*. Further alternatively, the radius of curvature of front-upper vertex 71*e* can be equal to the radius of curvature R2, and the radius of curvature of back-lower vertex 71*g* can be smaller than the radius of curvature R2 (back-lower vertex 71*g* can have the radius of curvature R1).

With this configuration, during the turn of lever 70 from the open position to the closed position, the outer peripheral face at both ends of wide-width part 71*i* in pivot shaft 71 comes into sliding contact with the inner surfaces of bearing 38. More specifically, back-lower vertex 71*g*, which is one end of wide-width part 71*i*, comes into sliding contact with first inner surface 38*e*, whereas front-upper vertex 71*e*, which is the other end, comes into sliding contact with inclined surface 38*f* of bottom surface 38*d* (the second inner surface).

In this configuration, the radius of curvature R1 of front-upper vertex 71*e* is smaller than the radius of curvature R2 of the other vertices, so that the force of front-upper vertex 71*e* to press bottom surface 38*d* can be concentrated on the vertices. In short, the compressive force can be concentrated on the straight line on which front-upper vertex 71*e* and bottom surface 38*d* come into contact with each other. As a result, front-upper vertex 71*e* becomes unlikely to slide with bottom surface 38*d*, thereby preventing lever 70 from turning from the open position to the closed position more reliably when cable 20 is not inserted in housing 30.

This configuration also provides the same action and effect as those of the exemplary embodiment described earlier.

In the exemplary embodiment, the holding parts are made to differ in position in height from the contact points by providing the stepped portions in the terminal housing portions. Alternatively, the same effect can be achieved by providing the inclined surfaces on the terminal housing portions, or by making the second housing portions differ in position in height from the first-terminal housing portions.

Each pivot shaft 71 may alternatively have a cross section of an ellipse, a polygon such as a substantial triangle, a star, etc., whereas each bearing 38 may be in the form of a cylinder with an opening inward in the width direction Y.

It is also possible to modify the specifications (shape, size, layout, etc.) of the housing, the lever, the cam portions, and other details.

What is claimed is:

1. A connector comprising:

a housing into which a planar cable is to be inserted, and including a first housing portion and a second housing portion;

a first terminal accommodated in the first housing portion and configured to be conductively connected to the cable; and a holding terminal accommodated in the second housing portion and configured to hold the cable, wherein the first terminal is identical in shape to the holding terminal and has a contact point configured to come into contact with the cable, the holding terminal has a holding part corresponding in position to the contact point of the first terminal and configured to hold the cable, when the housing is oriented so that a direction in which the cable is inserted and removed is horizontal, the holding part of the holding terminal accommodated in the second housing portion differs in position in height from the contact point of the first terminal accommodated in the first housing portion, the first terminal includes a first arm extending in the direction in which the cable is inserted and removed and having the contact point, the holding terminal includes a second arm extending in the direction in which the cable is inserted and removed and having the holding part, and at least one of the first housing portion and the second housing portion includes a stepped portion defined by first and second adjacent surfaces that are at different heights with respect to each other, wherein both the first and second adjacent surfaces of the stepped portion engage a portion of the at least one of the first and second arms, thereby causing the at least one of the first and second arms to be deflected such that a free end of the portion of the at least one of the first and second arms moves away from a housing surface on which the stepped portion is provided.

2. The connector according to claim 1, wherein when the housing is oriented so that the direction in which the cable is inserted and removed is horizontal and that the cable is inserted above the holding part and the contact point, the holding part is higher in position than the contact point.

3. The connector according to claim 1, wherein the second housing portion extends in the direction in which the cable is inserted and removed, and when the housing is oriented so that the direction in which the cable is inserted and removed is horizontal, and the cable is inserted in the housing, at least one of a top face and a bottom face of the second housing portion is closer to the cable on a removing side than on an insertion side in the direction in which the cable is inserted and removed.

4. The connector according to claim 1, wherein the first housing portion extends in the direction in which the cable is inserted and removed, and when the housing is oriented so that the direction in which the cable is inserted and removed is horizontal, and the cable is inserted in the housing, at least one of a top face and a bottom face of the first housing portion is closer to the cable on an insertion side than on a removing side in the direction in which the cable is inserted and removed.

5. A connector assembly comprising:

the connector as defined in claim 1; and the cable held in the holding terminal of the connector.

6. The connector according to claim 1, wherein the housing has a cable reception part that includes a top wall part and a bottom wall part opposing the top wall part, the top wall part and the bottom wall part configure the second housing portion, and at least one of the top wall part and the bottom wall part defines the housing surface on which the stepped portion is provided.

7. The connector according to claim 6, wherein the stepped portion is located at a portion opposing the second arm, on a surface of at least one of the top wall part and the bottom wall part.

8. The connector according to claim 7, wherein the holding terminal is sandwiched and held by the top wall part and the bottom wall part configuring the second housing portion.

* * * * *